US005344320A

United States Patent [19]

Inbar et al.

[11] Patent Number: 5,344,320

[45] Date of Patent: Sep. 6, 1994

[54] DUAL MODE APPARATUS FOR ASSISTING IN THE AIMING OF A FIREARM

[75] Inventors: Motti Inbar; Yosef Haimovich, both of Rishon Lezion, Israel

[73] Assignee: International Technologies (Lasers) Ltd., Rishon Lezion, Israel

[21] Appl. No.: 850,129

[22] Filed: Mar. 12, 1992

[30] Foreign Application Priority Data

Mar. 12, 1991 [IL] Israel ..... 97533

[51] Int. Cl.[5] ..... F41G 3/00

[52] U.S. Cl. ..... 434/22; 434/21; 434/19; 434/16; 434/11

[58] Field of Search ..... 434/11, 14–22; 273/310–316; 42/103

[56] References Cited

U.S. PATENT DOCUMENTS 4,352,665 10/1982 Kimble et al. ..... 434/22
4,640,514 2/1987 Myllyla et al. ..... 434/22 X
4,922,401 5/1990 Marshall et al. ..... 434/20 X
4,948,371 8/1990 Hall ..... 434/21

*Primary Examiner*—Richard J. Apley
*Assistant Examiner*—Glenn E. Richman
*Attorney, Agent, or Firm*—Ladas & Parry

[57] ABSTRACT

Dual mode apparatus for assisting in the aiming of a firearm including laser designating apparatus bore-sighted with the barrel of the firearm, apparatus for actuating the laser designating apparatus in a first mode of operation for illuminating an impingement location on a target while permitting normal operation of the firearm to shoot projectiles and apparatus for actuating the laser designating apparatus in a second mode of operation to illuminate an impingement location on a target with laser light in response to actuation of the trigger of the firearm.

7 Claims, 27 Drawing Sheets

5V
R13
10K
TP15
R14
10K
5V
R41
47
TP45
12V
R43
36K
TP44
C38
68pF
R31
51K
TP53
TL082CP
U33
R51
51K
SUM
R44
6.8K
C40
0.1
LM311
U42
1uF
16V
CT40
XIRQC
C19
680
74HC74
U13
5V
TP64
XIRQ

74HC08
U74
XIRQR
RESET
XIRQC

LED1
R92
270
LED91
TLR114

LED2
R91
270
LED92
TLR114

LASER DRIVE

DUAL MODE APPARATUS FOR ASSISTING IN THE AIMING OF A FIREARM

FIELD OF THE INVENTION

The present invention relates to aiming apparatus for use with firearms generally.

BACKGROUND OF THE INVENTION

Various types of apparatus is known for assisting aiming of firearms. There is known, for example, and commercially available from International Technologies (Lasers) Ltd. of Rishon-Le-Zion, Israel, a rifle mounted laser designator, identified by catalog number AIM-1 P.N. 852000019, which is boresighted with the rifle barrel and provides a laser point indication onto which the rifle may be aimed.

There are also known electronic systems for target practice wherein operation of a firearm provides a laser output rather than a projectile. The propinquity of the laser output to target coordinates is electrically sensed so as to provide an output indication of aiming accuracy.

SUMMARY OF THE INVENTION

The present invention seeks to provide improved apparatus for assisting in the aiming of a firearm.

There is thus provided in accordance with a preferred embodiment of the present invention dual mode apparatus for assisting in the aiming of a firearm including laser designating apparatus boresighted with the barrel of the firearm, apparatus for actuating the laser designating apparatus in a first mode of operation for illuminating an impingement location on a target while permitting normal operation of the firearm to shoot projectiles and apparatus for actuating the laser designating apparatus in a second mode of operation to illuminate an impingement location on a target with laser light in response to actuation of the trigger of the firearm.

Additionally in accordance with a preferred embodiment of the present invention there is provided a target practice system including:

- laser designating apparatus boresighted with the barrel of the firearm;
- apparatus for actuating the laser designating apparatus to illuminate an impingement location on a target with laser light at an impingement location in response to actuation of the trigger of the firearm;
- target apparatus defining a target reference and including sensor apparatus for sensing the spatial relationship between the impingement location and the target reference; and
- apparatus for providing a hard copy output indication of the spatial relationship between the impingement location and the target reference.

Further in accordance with a preferred embodiment of the present invention there is provided a target practice system including:

- laser designating apparatus boresighted with the barrel of the firearm;
- apparatus for actuating the laser designating apparatus to illuminate an impingement location on a target with laser light in response to actuation of the trigger of the firearm; and
- target apparatus defining a target reference and including sensor apparatus for sensing the spatial relationship between the impingement location and the target reference, the target apparatus comprising a laser light diffuser for scattering received laser light and said sensor apparatus being operative for sensing the spatial distribution of the scattered received laser light.

Additionally in accordance with a preferred embodiment of the invention there is provided a target practice system including:

- laser designating means boresighted with the barrel of the firearm;
- means for actuating the laser designating means in a first mode of operation for illuminating a target while permitting normal operation of the firearm to shoot projectiles;
- means for actuating the laser designating means in a second mode of operation to illuminate a target with laser light in response to actuation off the trigger of the firearm; and
- target means defining a target reference and including sensor means for sensing the spatial relationship between the impingement location and the target reference.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
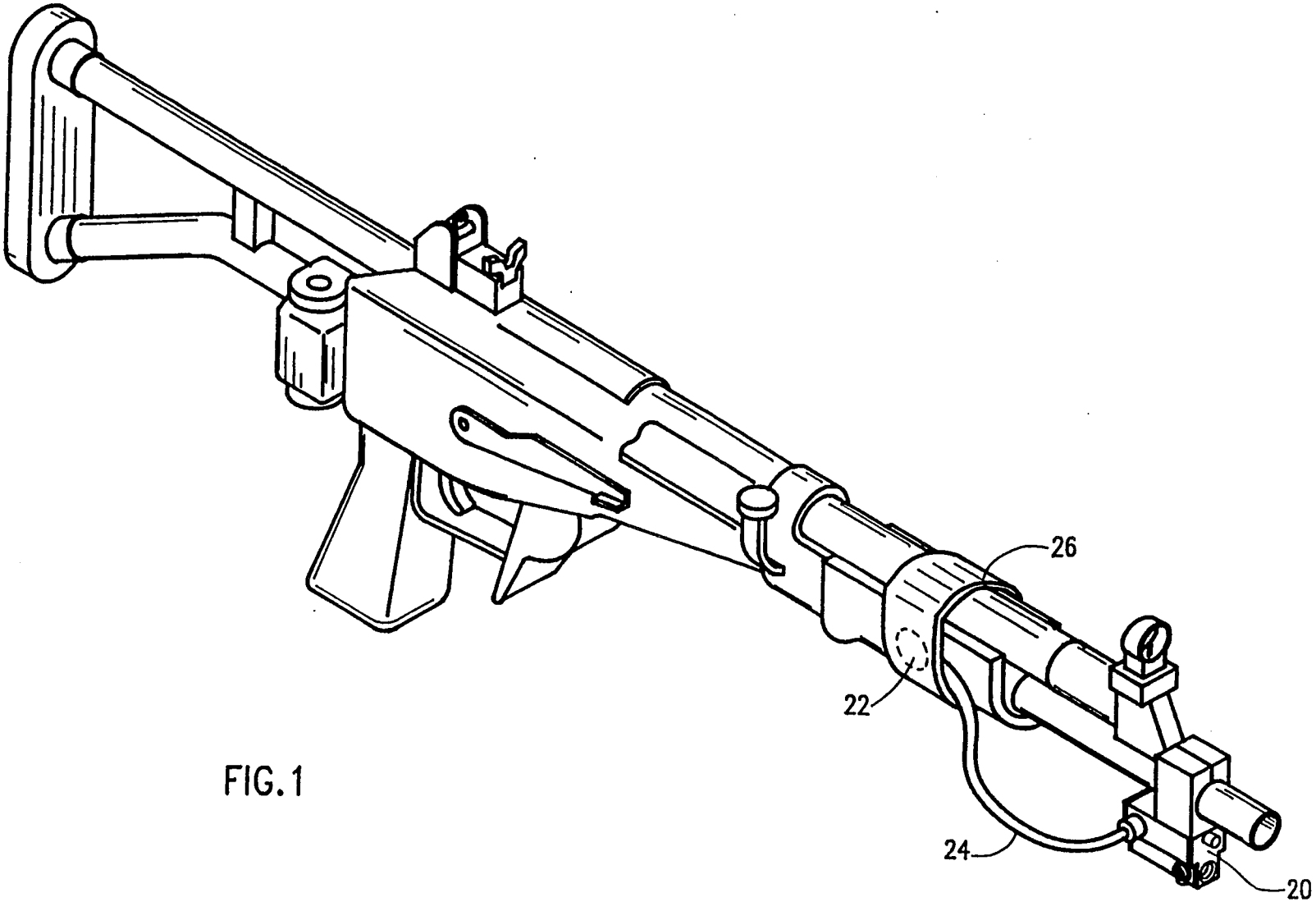
FIG. 1 is a pictorial illustration of a firearm having mounted thereon a laser designator constructed and operative in accordance with a preferred embodiment of the present invention.

Reference is now made to FIGS. 1, 2A, 2B and 3, which illustrate a dual mode firearm mounted laser designator constructed and operative in accordance with a preferred embodiment of the present invention . The laser designator, indicated generally by reference numeral 20, is preferably mounted onto the barrel of a firearm, such as a rifle.

In accordance with one embodiment of the present invention, it may be operated by a remote control switch 22, connected to the designator by a cable 24 and mounted on the firearm by means of a band 26.

Figure 2A:
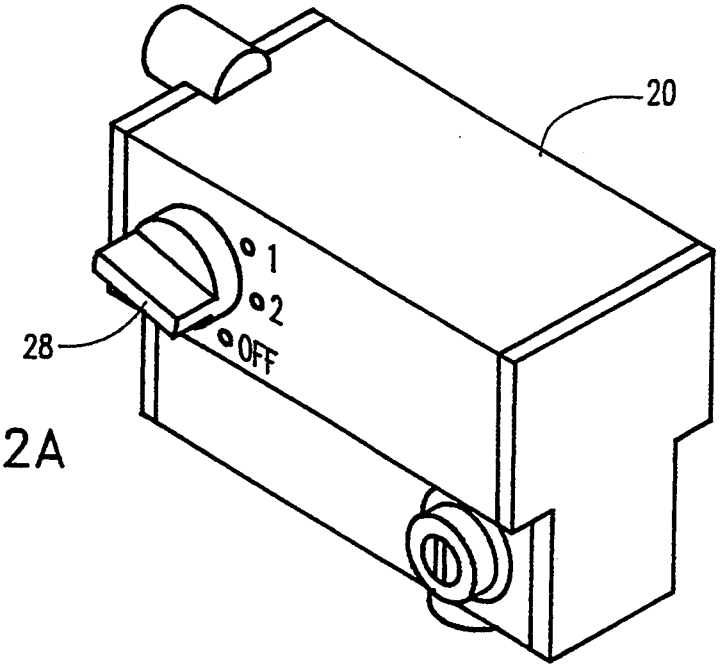
FIGS. 2A and 2B are respective front and back pictorial illustrations of a preferred dual mode laser designator constructed and operative in accordance with a preferred embodiment of the present invention.
Figure 2B:
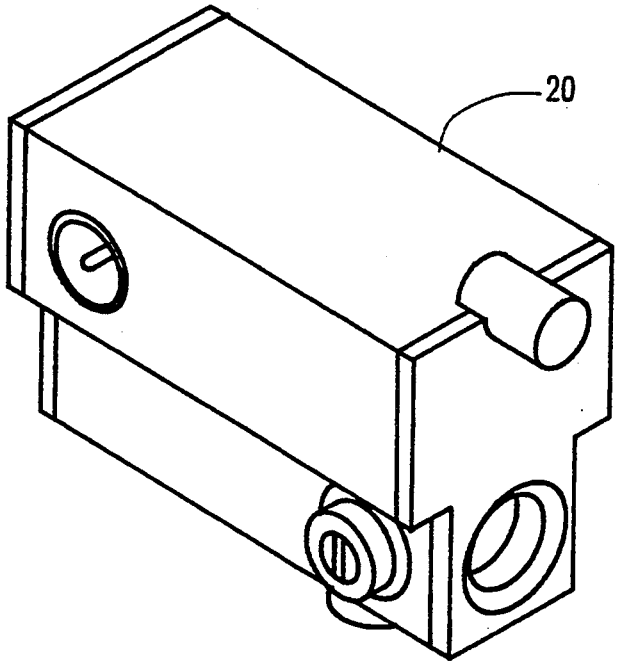
Figure 3:
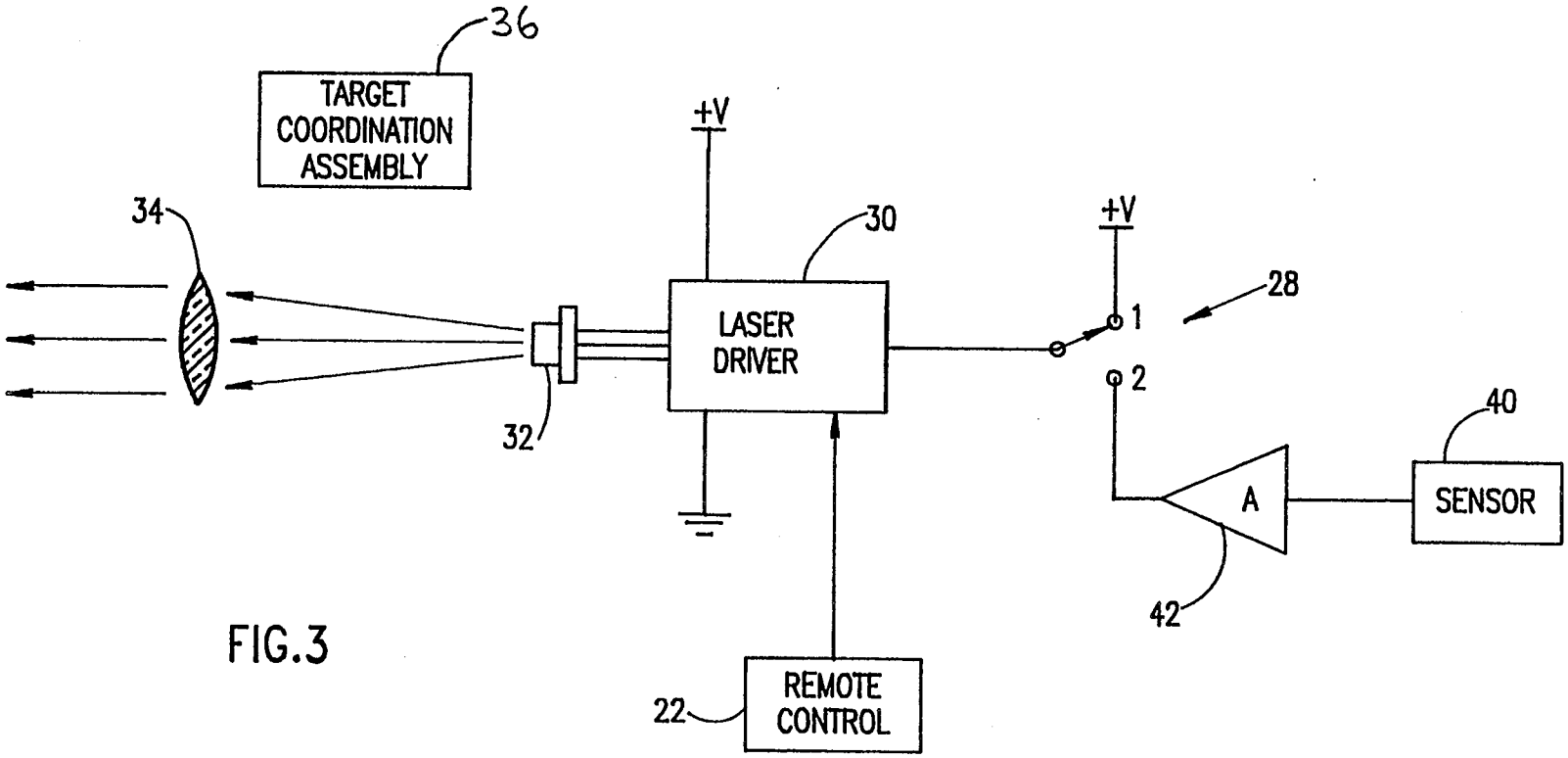
FIG. 3 is a simplified block diagram illustration of the dual mode laser designator of FIGS. 2A and 2B.

As seen in FIGS. 2A and 3, the designator 20 includes a mode select switch 28 which enables a user to select operation in one of two modes, mode 1, an operational mode and mode 2, a target practice mode.

When the designator 20 is in the operational mode, voltage is provided to a laser driver 30 producing a laser output from a laser 32, such as a diode laser via a collimating lens 34, in response to actuation of an operator control switch, such as remote control switch 22.

The laser 32, collimating lens 34 and remote control switch 22 as well as a target coordination assembly 36 are all incorporated in known laser designating apparatus, such as the aforesaid rifle mounted laser designator, identified by catalog number AIM-1 P.N. 852000019. A schematic illustration of a preferred laser driver 30 appears in FIG. 18.

In accordance with a preferred embodiment of the present invention, the dual mode designator of the present invention also comprises a firing sensor 40, such as a piezoelectric sensor, a microphone, a pressure transducer, accelerometer, vibration sensor or force sensor, which is employed to sense the firing of a blank cartridge or even trigger actuation in the absence of a cartridge . The output of sensor 40 is supplied via an amplifier 42 and via mode switch 28, when in the second mode select position, to the laser driver 30 for actuation thereof in response to actuation of the firearm trigger, thereby providing simulated firing by means of a laser beam. For this purpose the time difference between trigger actuation and laser beam emission is assumed to be negligible .

Figure 4:
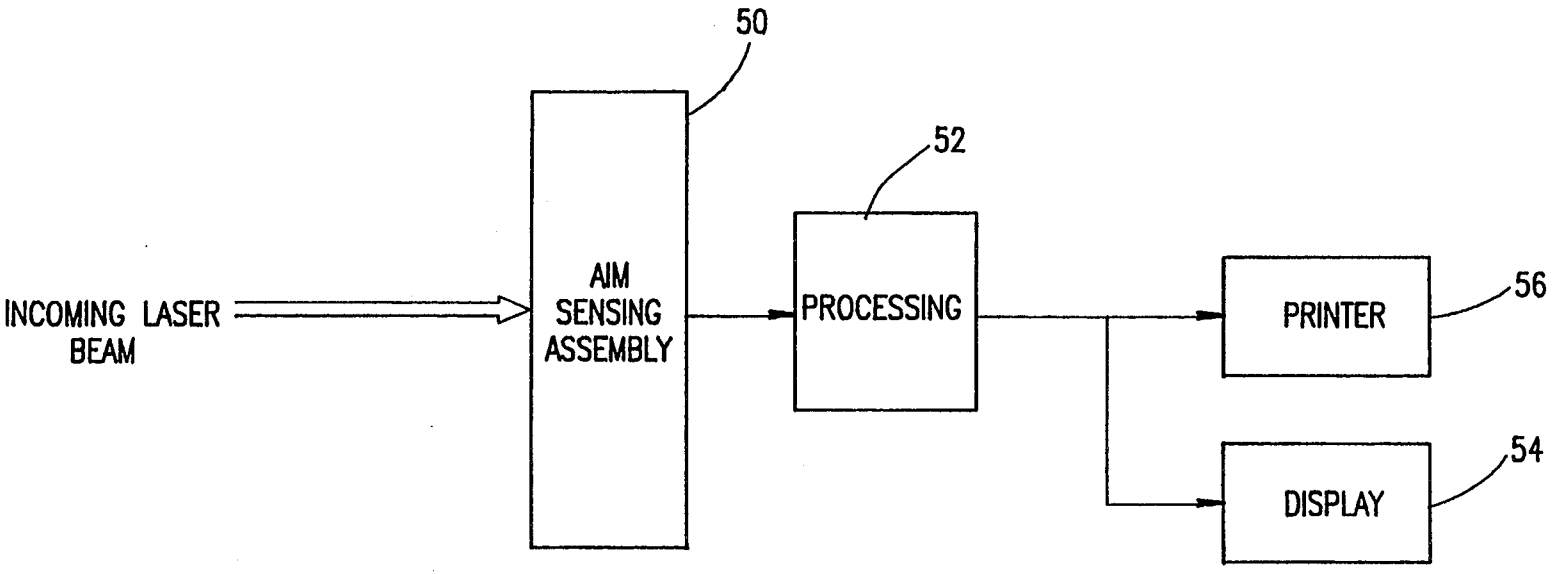
FIG. 4 is a simplified block diagram illustration of a target practice system constructed and operative in accordance with a preferred embodiment of the present invention.

Reference is now made to FIG. 4, which is a simplified block diagram illustration of a target practice system constructed and operative in accordance with a preferred embodiment of the present invention. Generally speaking, the system of FIG. 4 comprises an aim sensing assembly 50 which outputs via processing circuitry 52 to output indication apparatus which preferably includes a display 54 and or a printer 56. It is a particular feature of a preferred embodiment of the present invention that a hard copy of the target practice results is provided.

Figure 5:
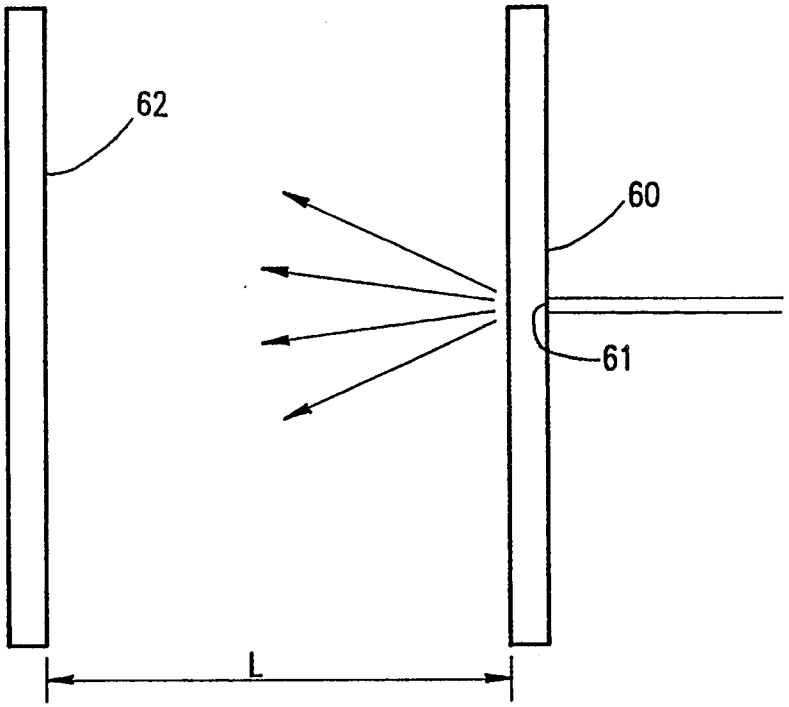
FIG. 5 is a simplified block diagram illustration of a target impingement sensing subsystem of the system of FIG. 4.
Figure 6:
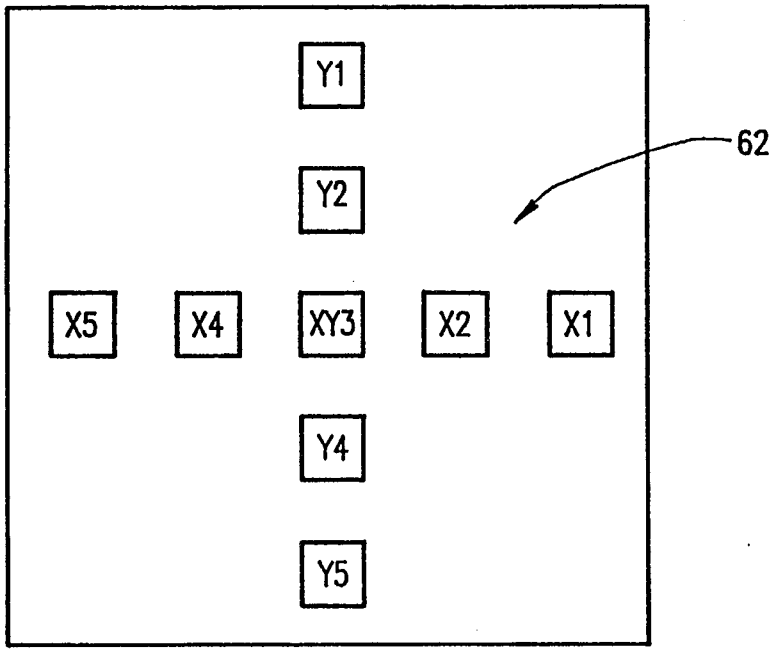
FIG. 6 is an illustration of a preferred target array employed in the subsystem of FIG. 5.
Figure 7A:
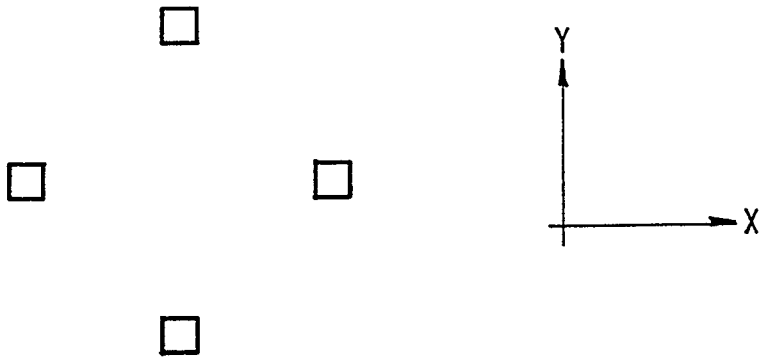
FIGS. 7A, 7B, 7C and 7D are illustrations of four different arrangement of target references useful in the system of FIG. 4.
Figure 7B:
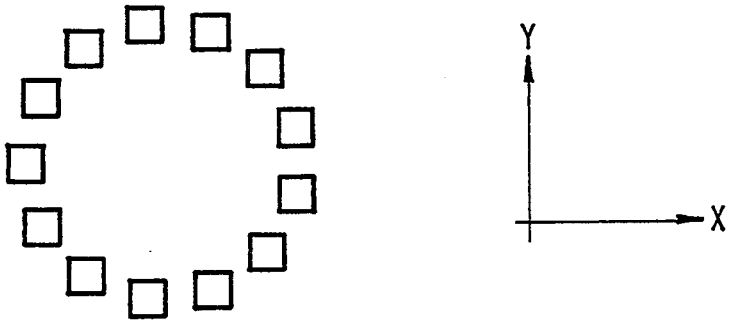
Figure 7C:
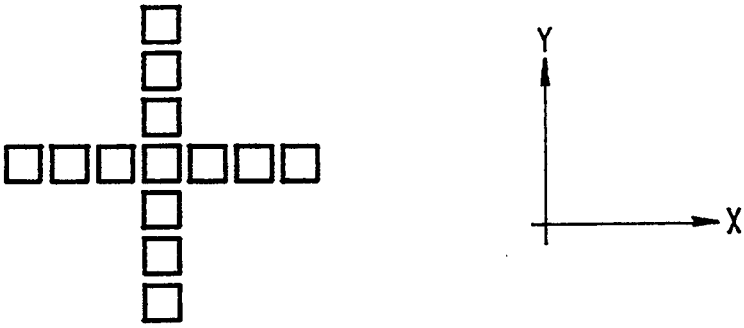
Figure 7D:
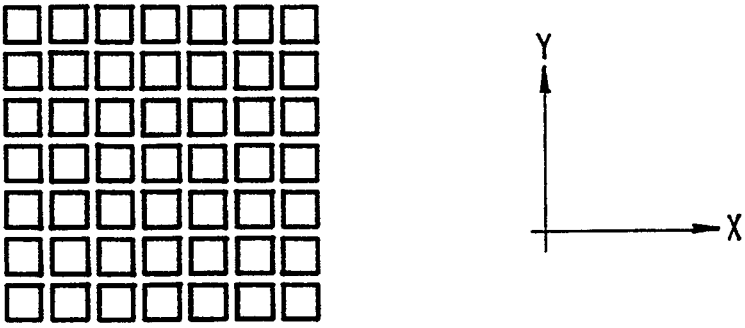

Referring now to FIGS. 5 and 6, it is seen that according to a preferred embodiment of the present invention, the aim sensing assembly comprises a laser light diffuser 60, such as a piece of ground glass or a sheet of translucent polycarbonate plastic, which produces scattering of the incoming laser light. The scattered light defines a three dimensional near-Gaussian distribution centered about the impingement location 61 of the light on the diffuser 60.

In accordance with a preferred embodiment of the present invention, the near-Gaussian distribution is sampled by a plurality of detectors 62 in order to provide an accurate output indication of the position of the impingement location and thus of the accuracy of the aim.

FIGS. 7A–7D illustrate four from among a large variety of possible detector array configurations. It is particularly noted that it is not necessary for the detectors to cover the entire target area due to the circular symmetry of the near-Gaussian distribution of scattered light.

Figure 8:
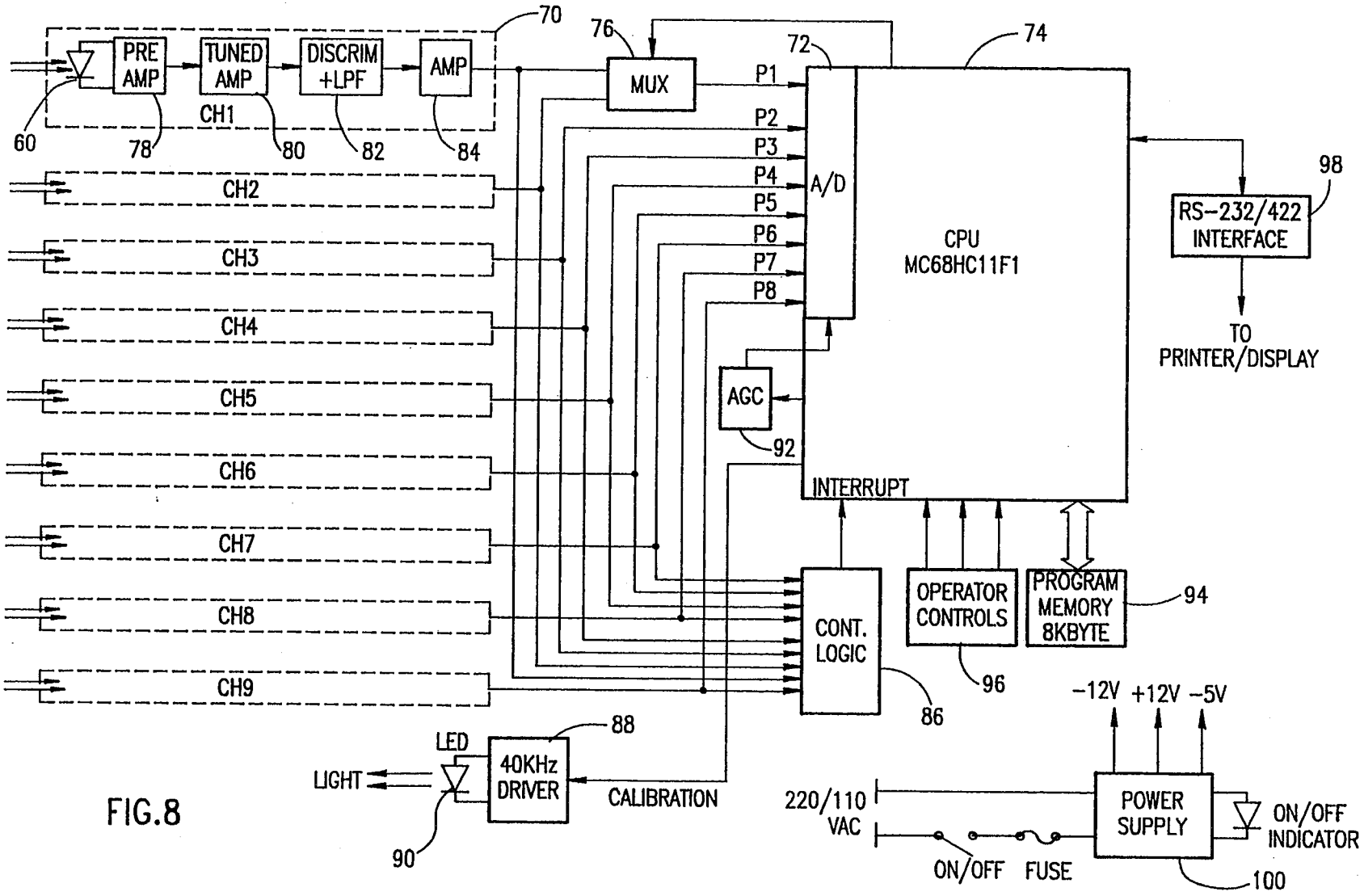
FIG. 8 is an electronic block diagram illustration of the signal processing subsystem of the system of FIG. 4.

Reference is now made to FIG. 8, which is a simplified block diagram illustration of processing circuitry 52 of the system of FIG. 4 configured for the detector configuration of FIG. 6. It is seen that nine pre-processing channels 70 are preferably provided, one for each detector 62, which is typically a pin diode detector. The nine channels 70 may be identical and their outputs are preferably supplied via an 8-channel A–D converter 72 to a microcontroller, such as an MC68HC11Fl, including a CPU 74. It is noted that two of the outputs of the nine channels are multiplexed by a multiplexer 76, so as to enable the 8-channel A–D converter 72 to accommodate all nine pre-processing channels 70.

Figure 9A:
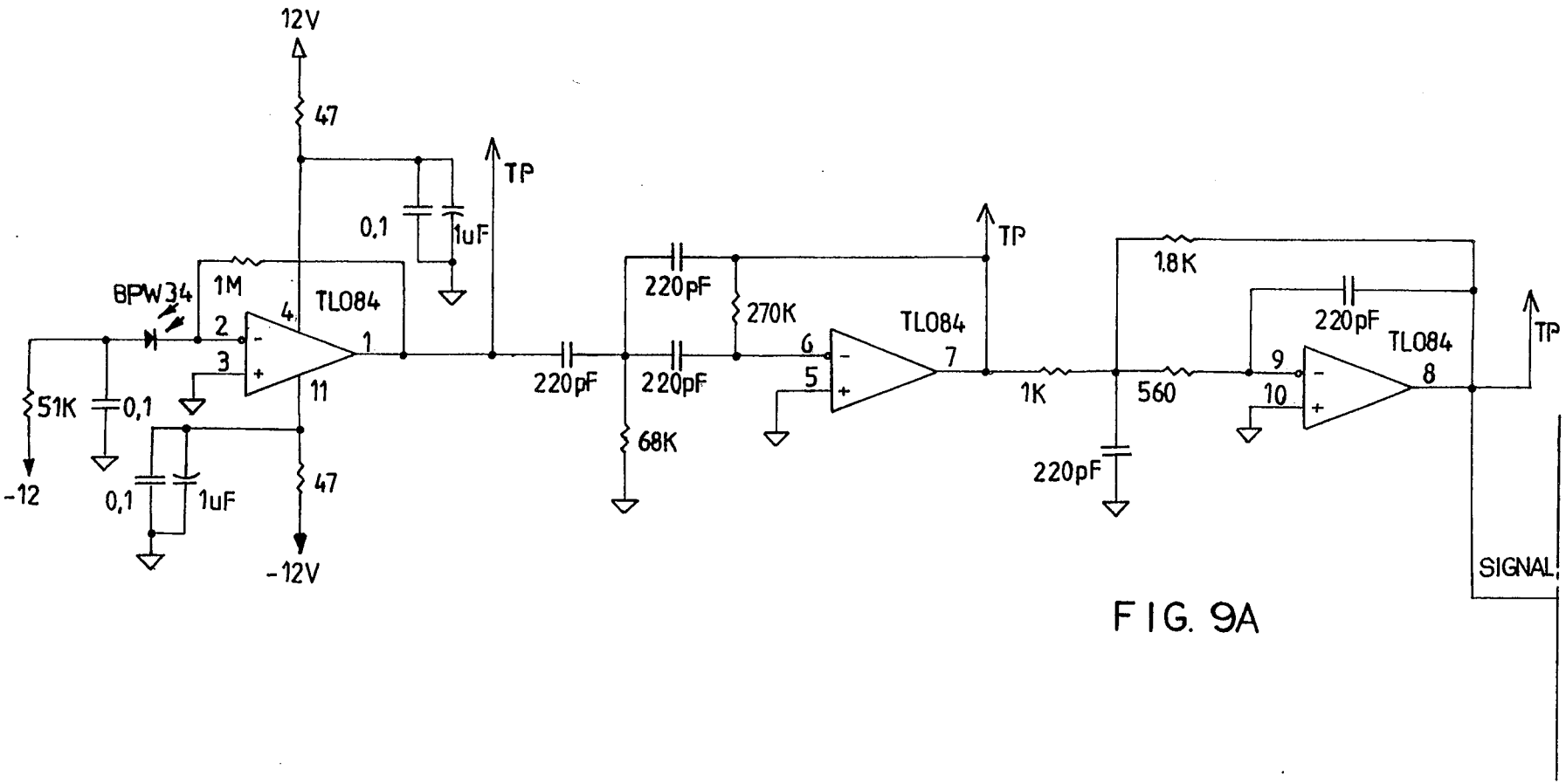
FIGS. 9A, 9B and 9C constitute an electrical schematic diagram of processing circuitry associated with each individual target sensor in the subsystem of FIG. 8.
Figures 9B, 9C:
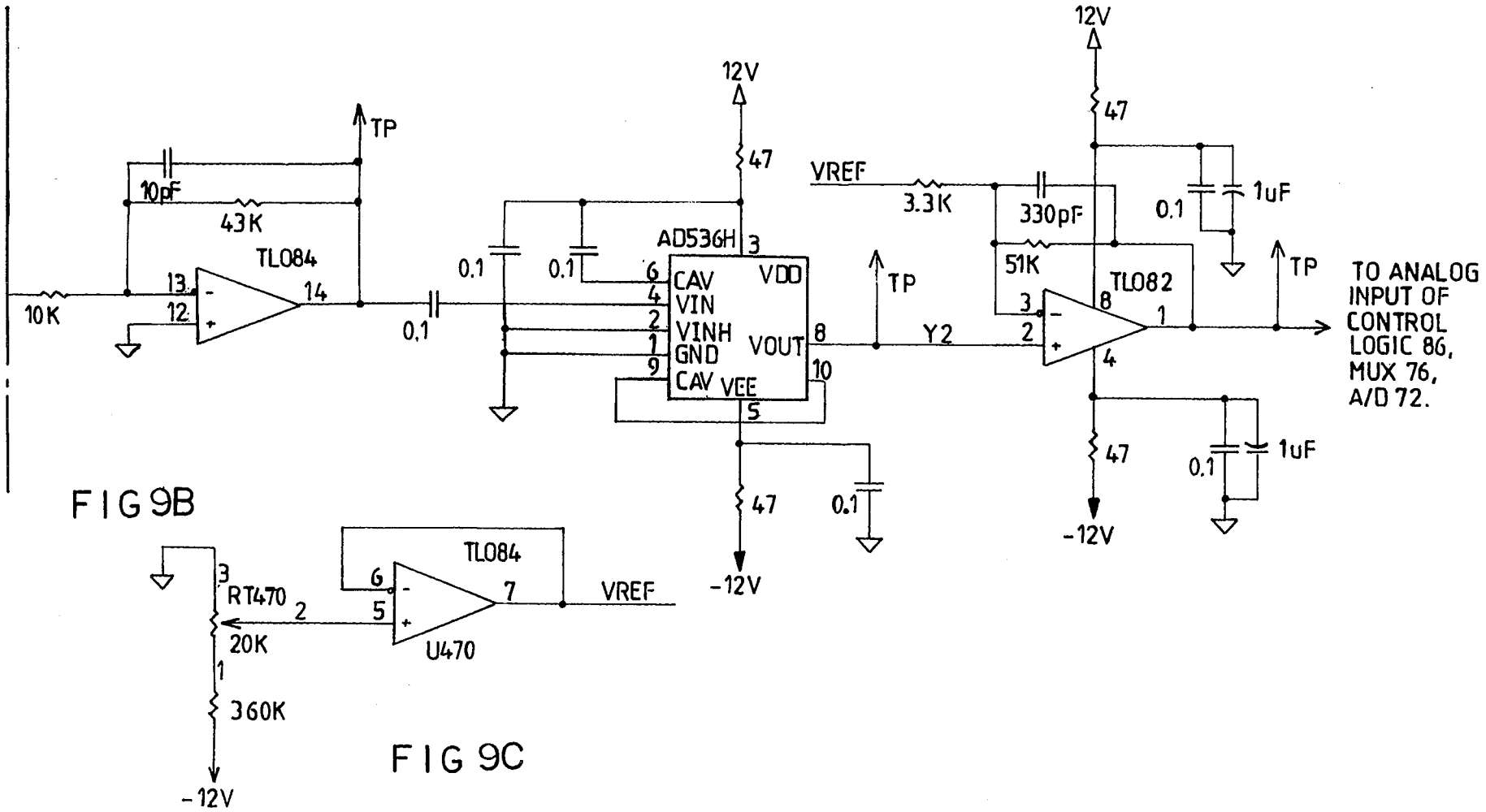
Figure 10A:
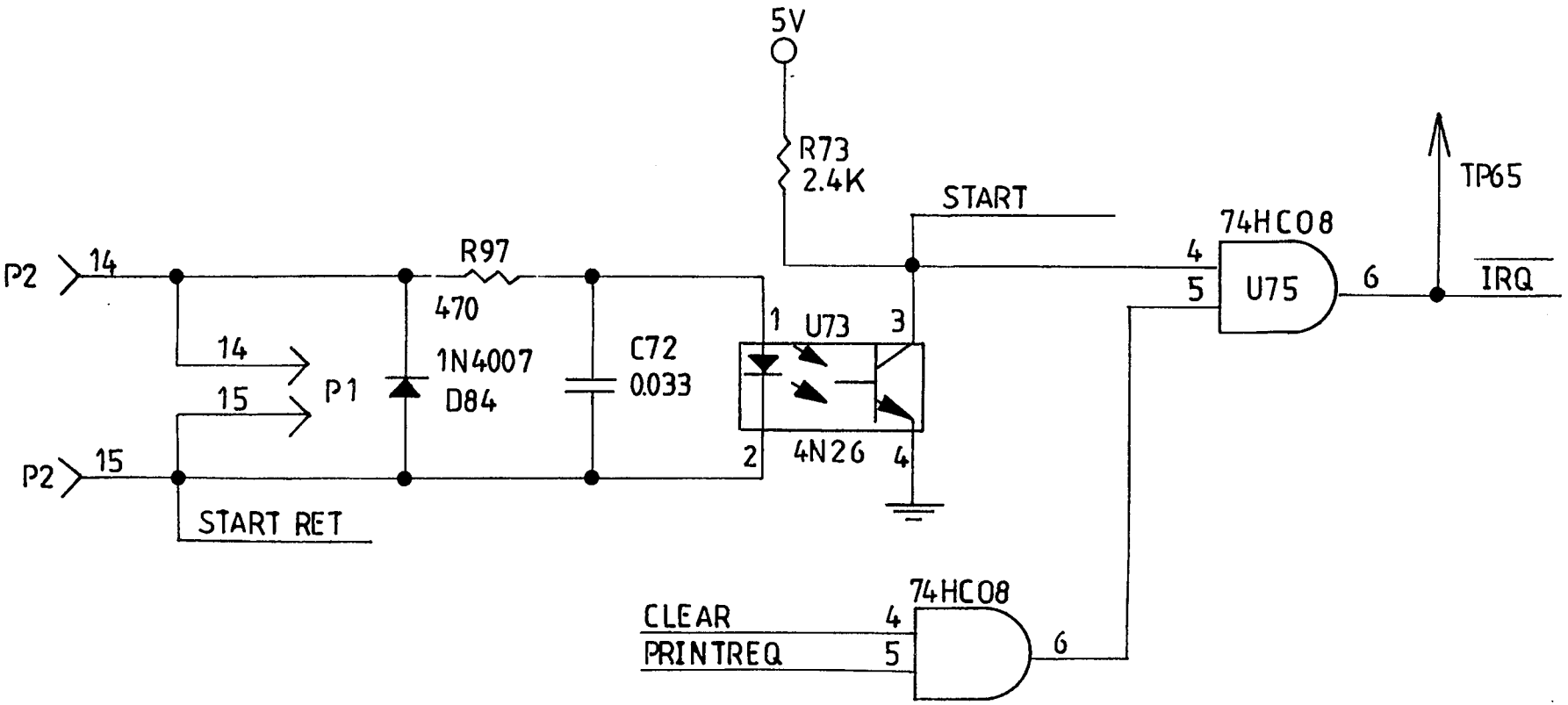
FIGS. 10A–10E constitute an electrical schematic diagram of a CPU and memory in the subsystem of FIG. 8.
Figure 10B:
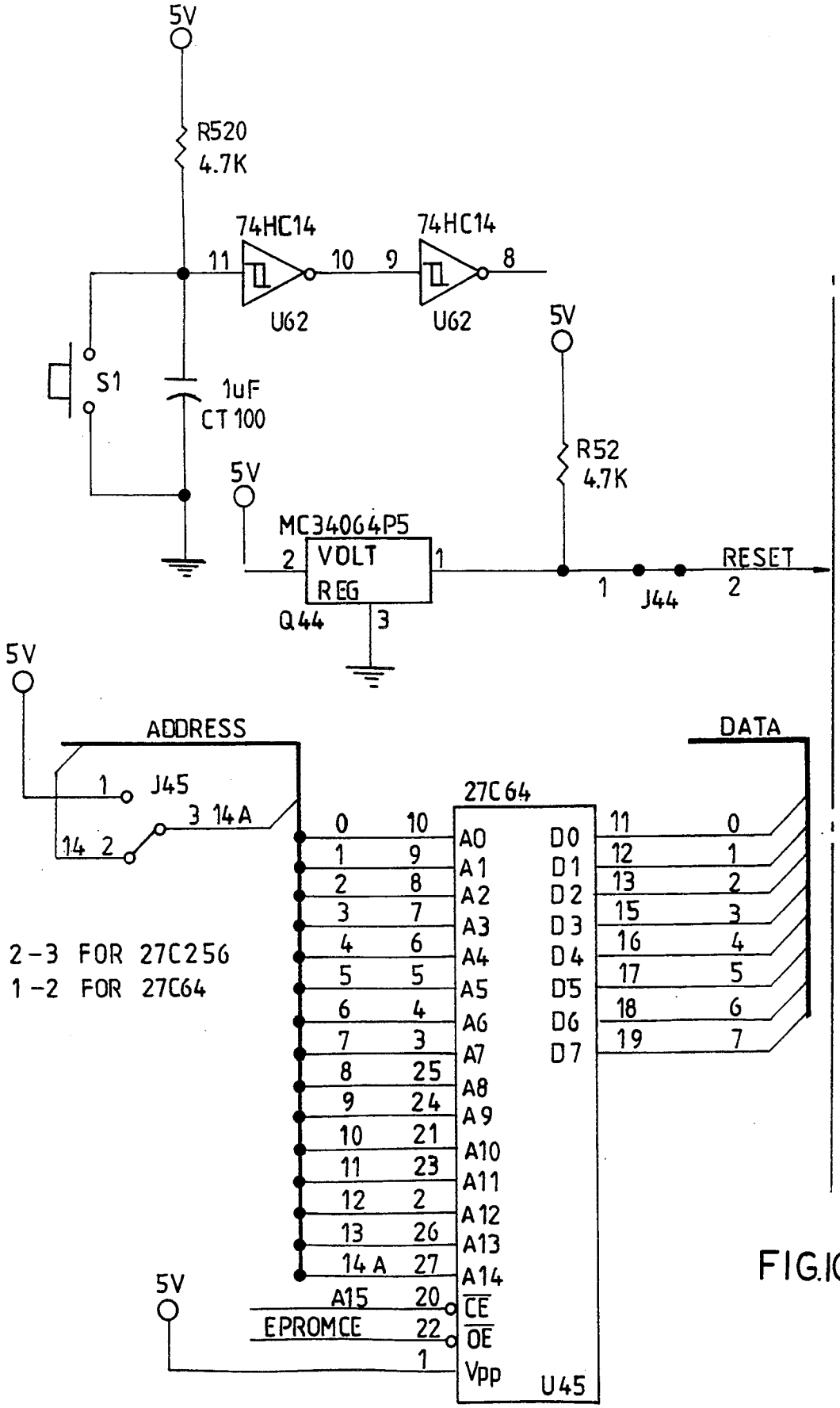
Figure 10C:
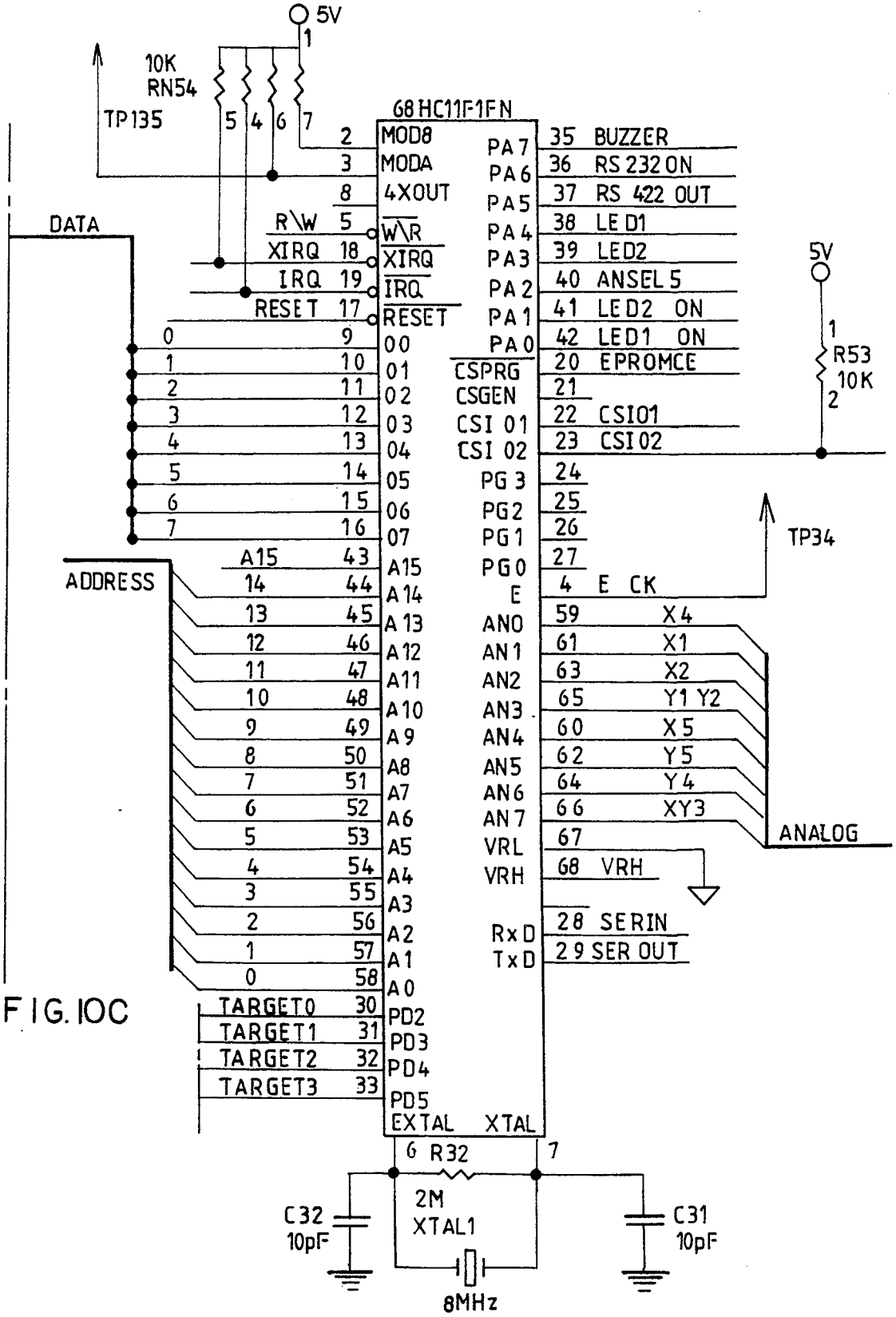
Figure 10D:
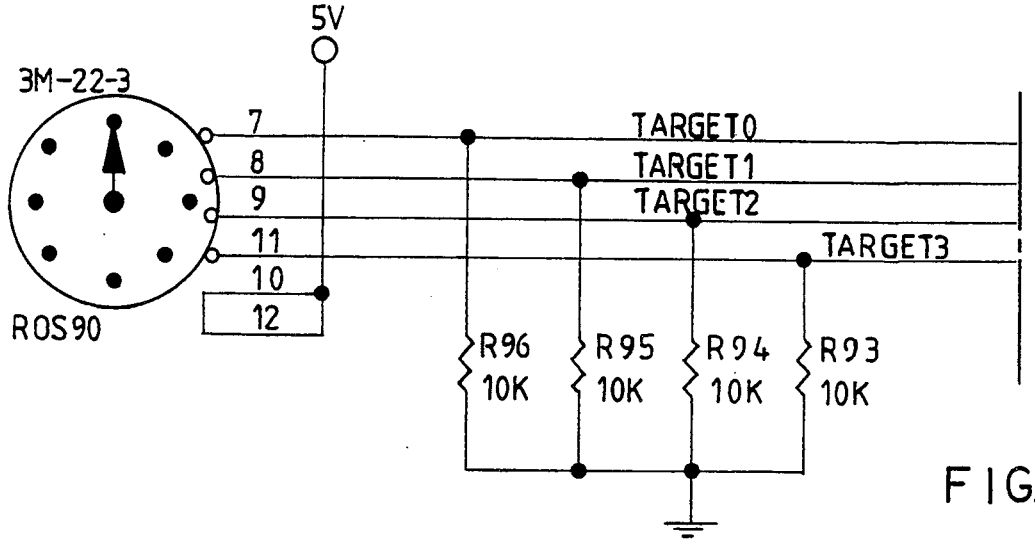
Figure 10E:
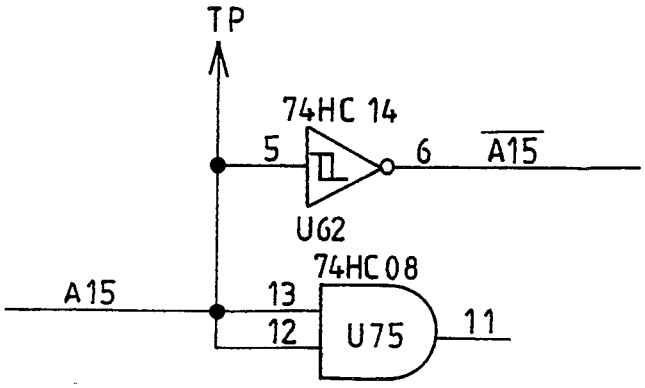

Each of the pre-processing channels 70 typically includes a pre-amplifier 78 which receives the output of detector 60 and which outputs to a tuned amplifier 80. The tuned amplifier 80 outputs via discrimination and low pass filter circuitry 82 to an amplifier 84, whose output is the output of each channel. A schematic illustration of a typical pre-processing channel 70 appears in FIGS. 9A–9C. This schematic illustration, as well as all other schematic illustrations referenced in the specification are believed to be fully descriptive. Therefore, in the interests of conciseness, a textual description corresponding thereto is not provided.

Figures 15A, 15B:
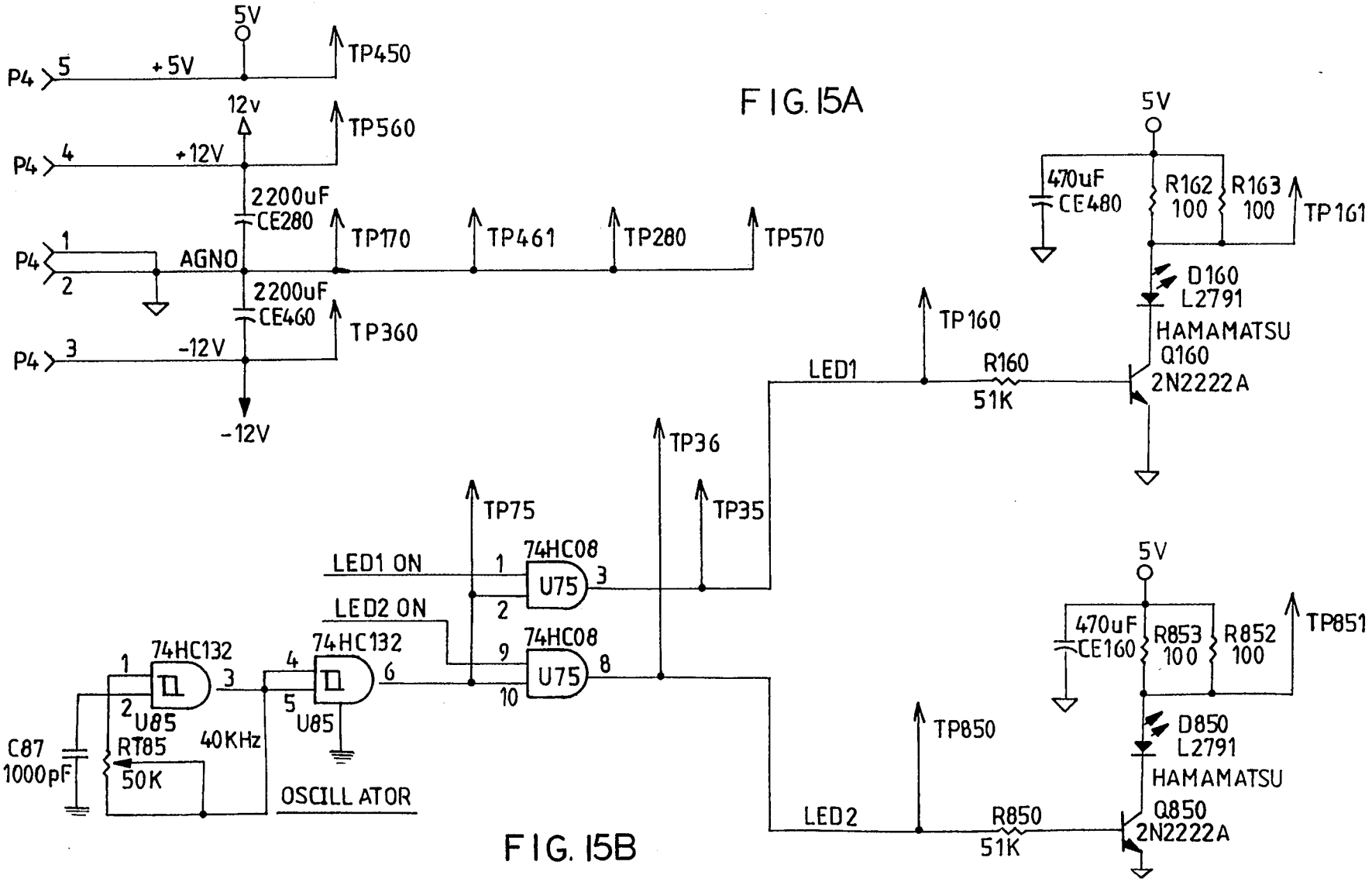
FIGS. 15A and 15B constitute an electrical schematic illustration of automatic calibration circuitry which may be employed in the subsystem of FIG. 8.
Figure 16A:
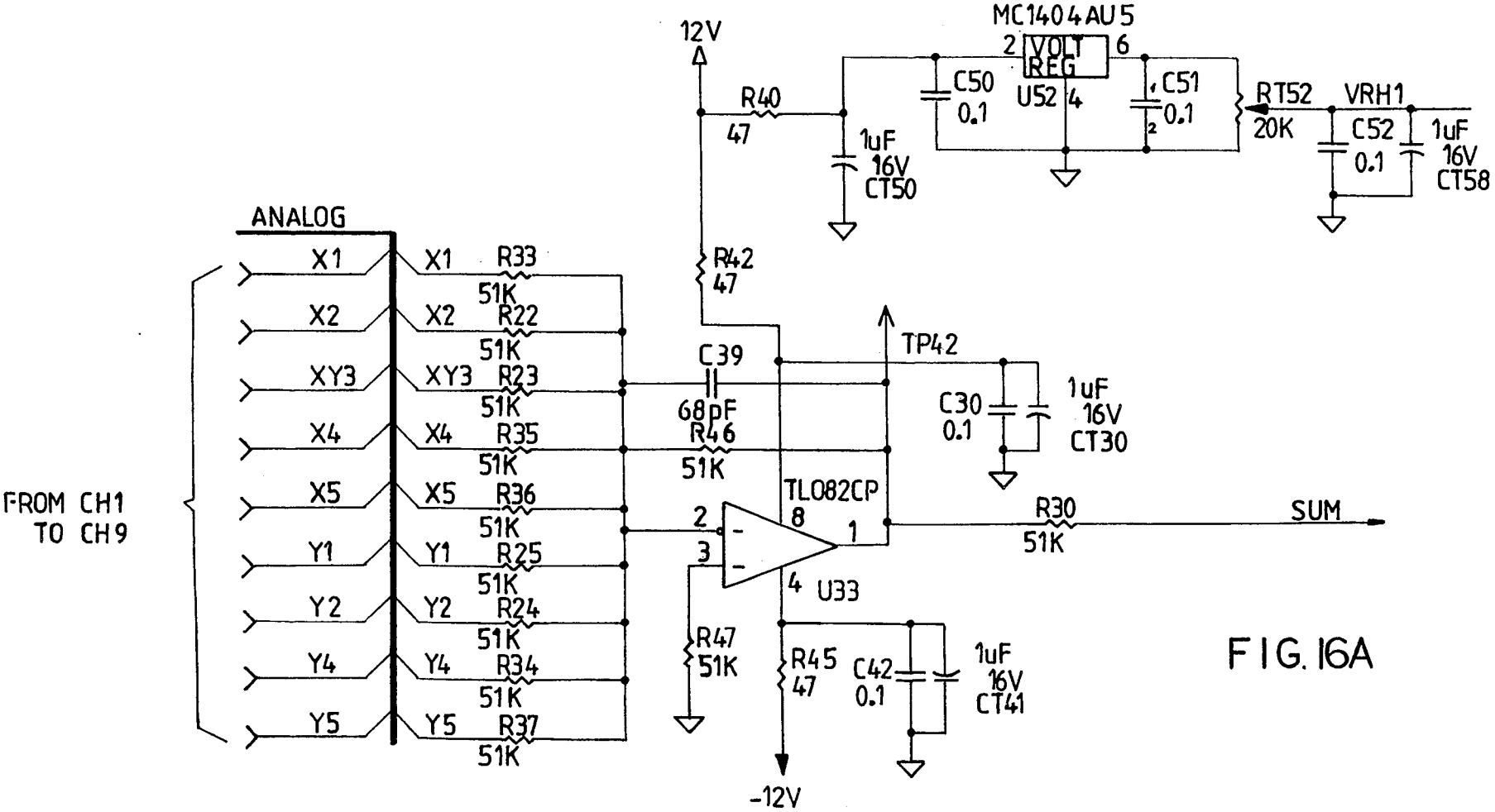
FIGS. 16A, 16B, 16C and 16D constitute an electrical schematic illustration of control logic circuitry employed in the subsystem of FIG. 8.
Figures 16B, 16C, 16D, 16E:
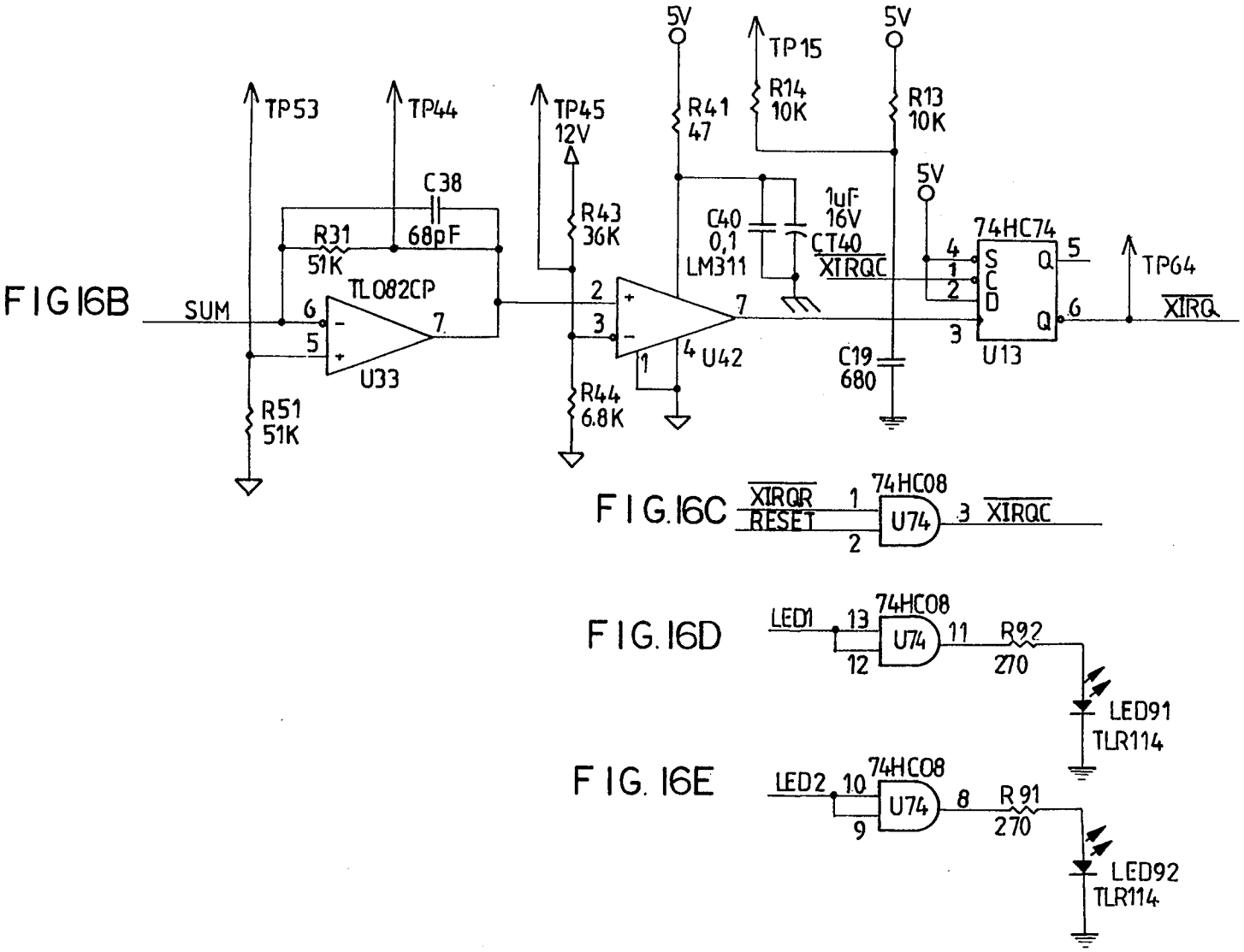
Figure 17A:
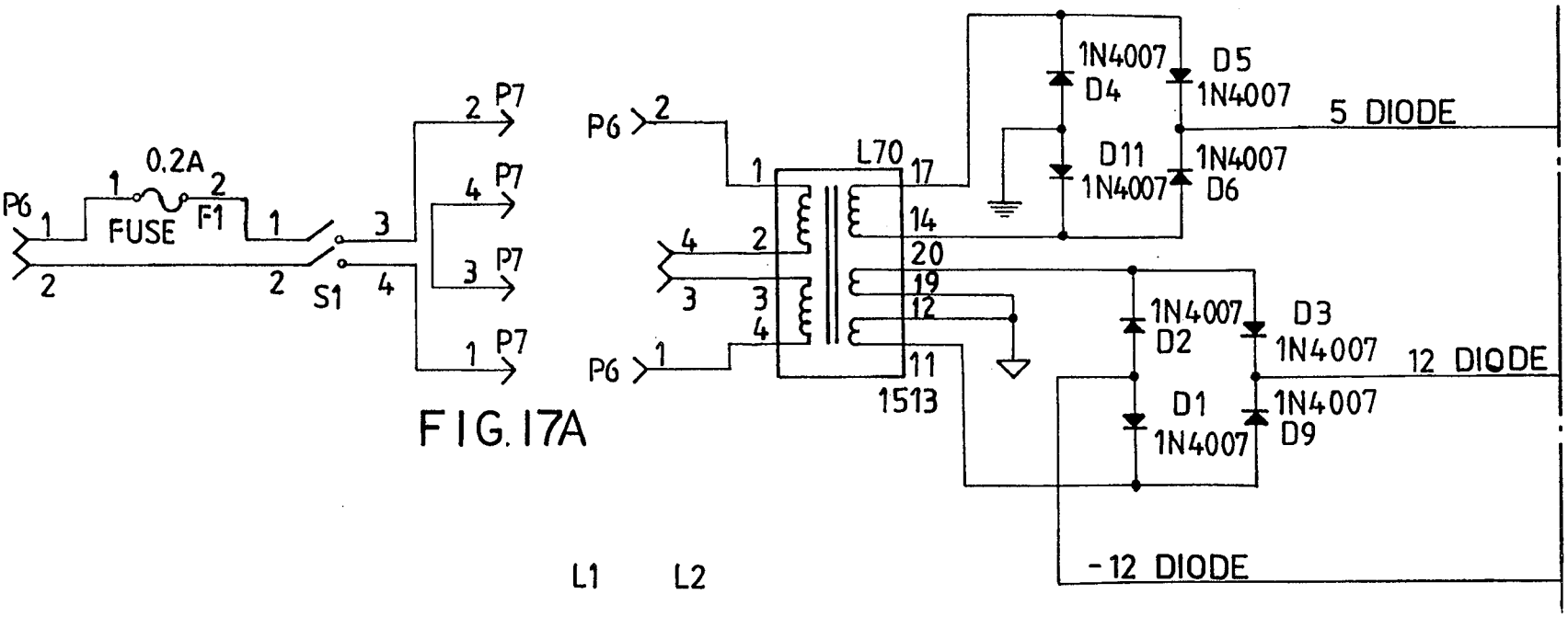
FIGS. 17A, 17B, 17C and 17D constitute an electrical schematic illustration of a power supply circuit employed in the subsystem of FIG. 8.
Figure 17C:
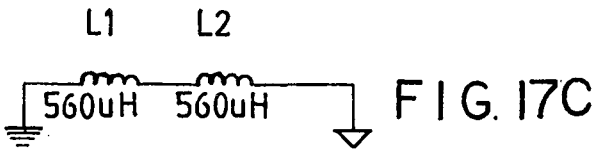
Figure 17D:
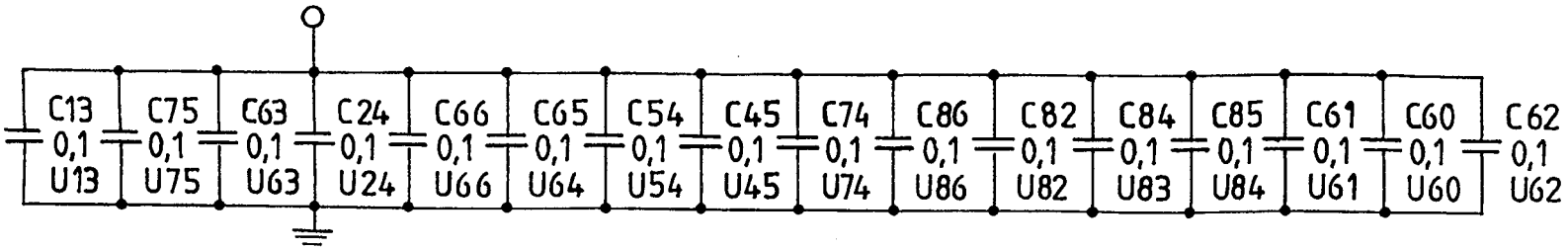
Figure 17B:
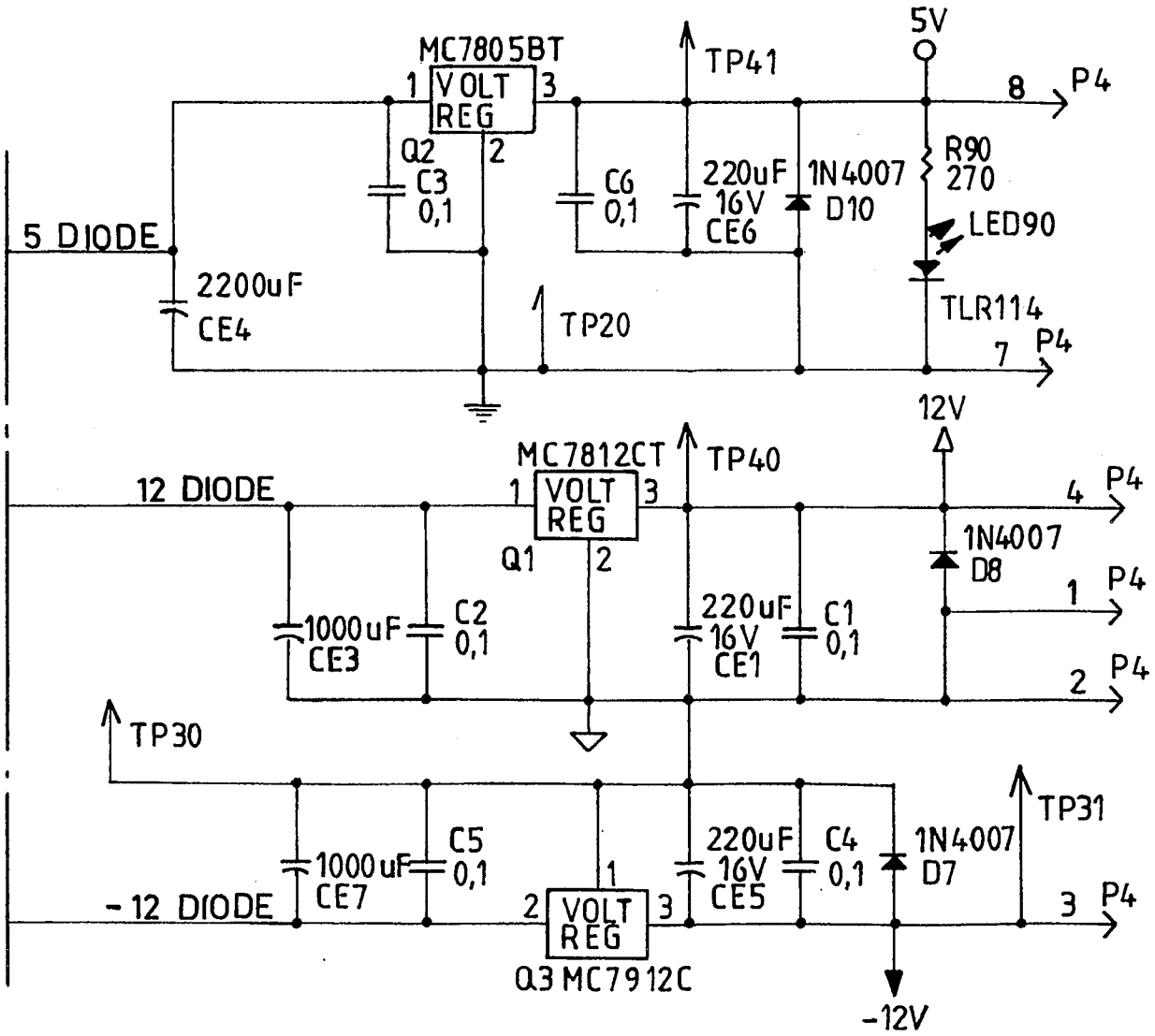
Figure 18A:
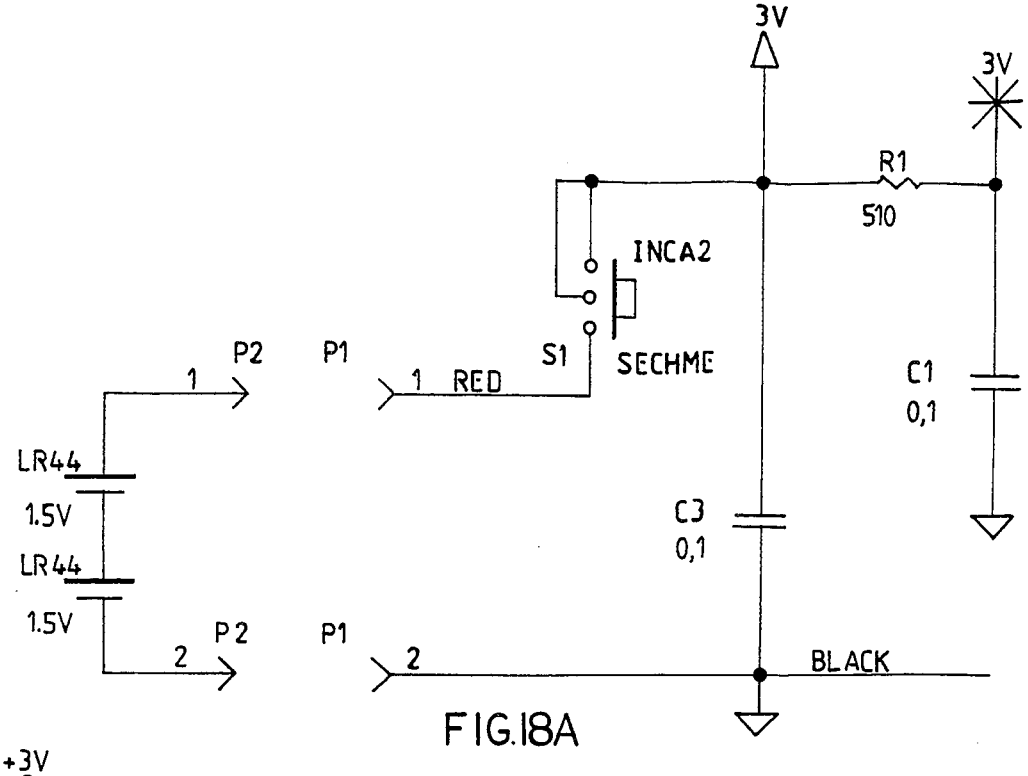
FIGS. 18A–18E constitute an electrical schematic illustration of a laser driver employed in the system of FIG. 3.
Figure 18B:
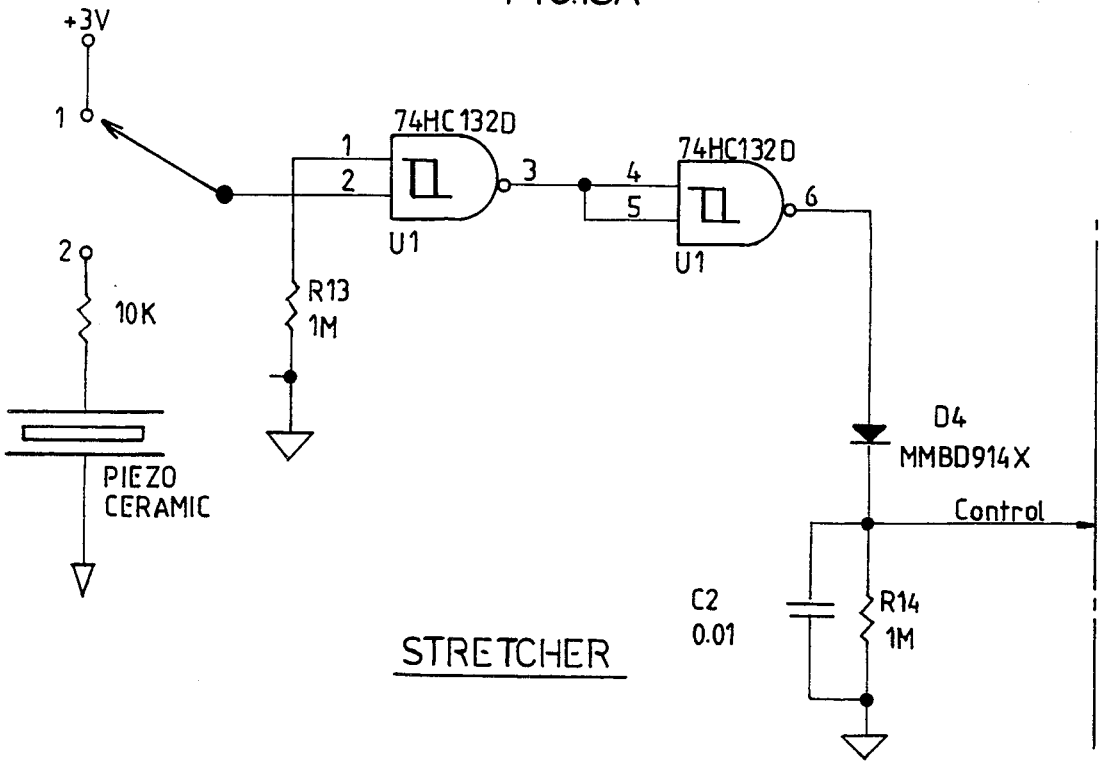
Figure 18C:
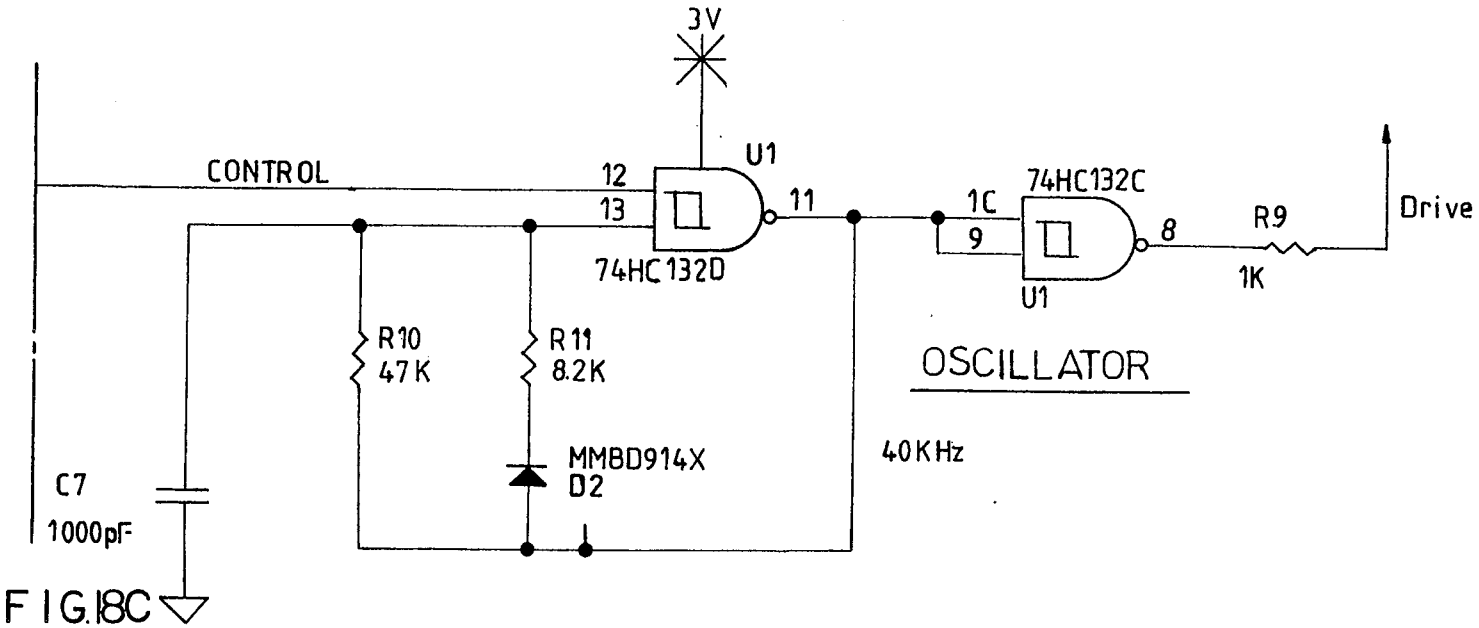
Figure 18D:
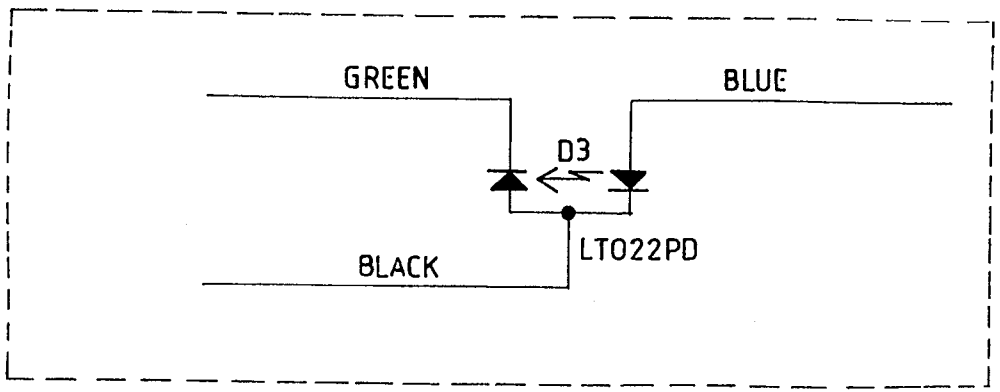
Figure 18E:
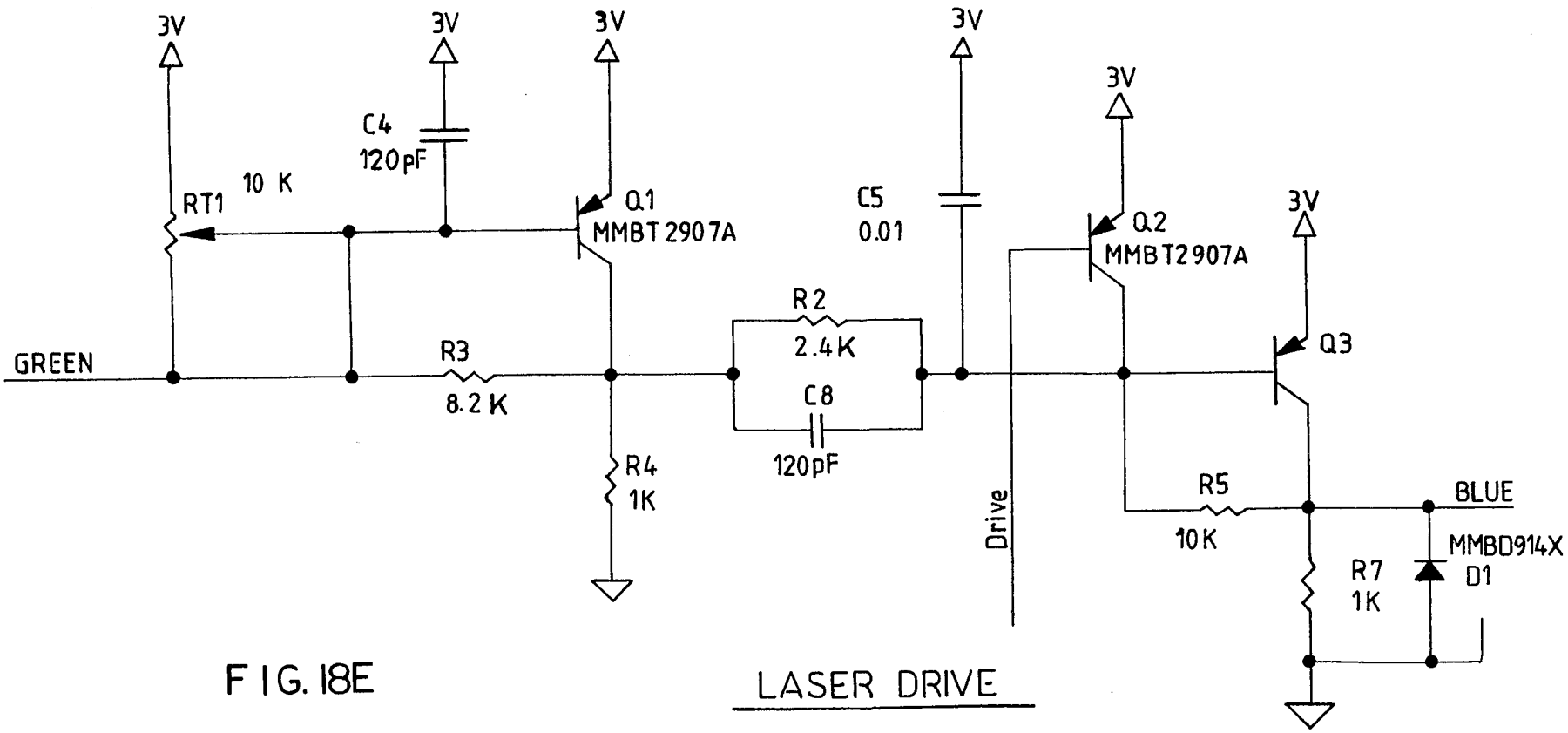

The outputs of each of channels 70, each corresponding to a single detector 60 is also supplied to control logic circuitry 86. Calibration circuitry may be provided, including a driver 88 which operates an LED 90 for providing a calibration function. FIGS. 16A and 16B constitute an electrical schematic illustration of the control logic circuitry 86 and FIGS. 15A and 15B constitute an electrical schematic illustration of automatic calibration circuitry employed in the subsystem of FIG. 8.

Figure 11:
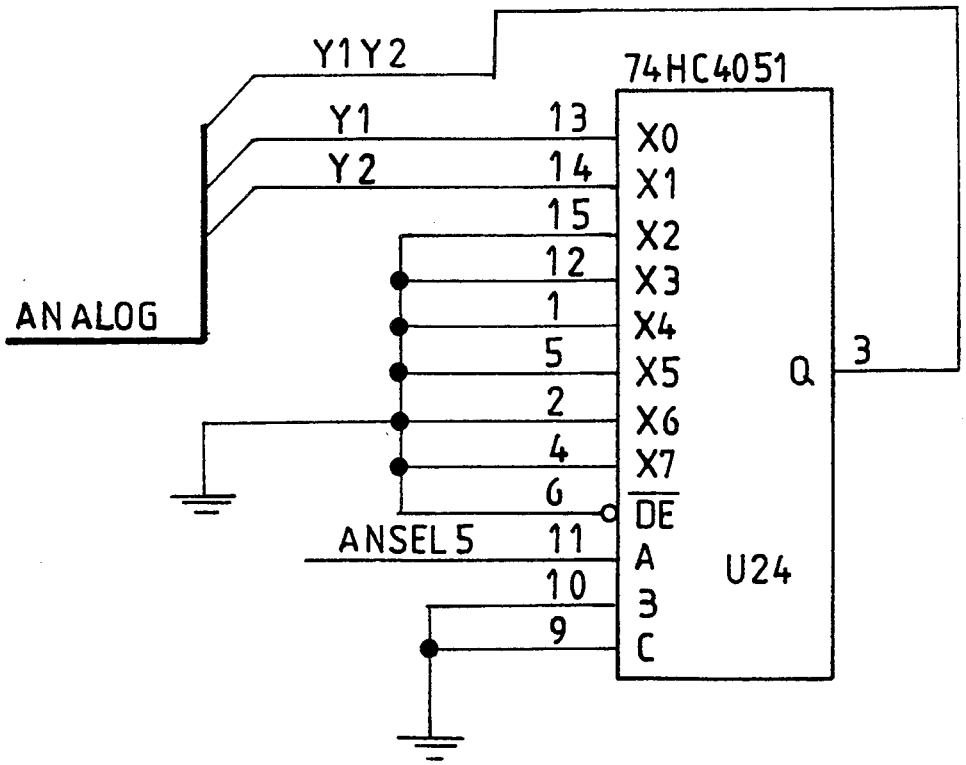
FIG. 11 is an electrical schematic diagram of a multiplexer employed in the subsystem of FIG. 8.
Figure 12:
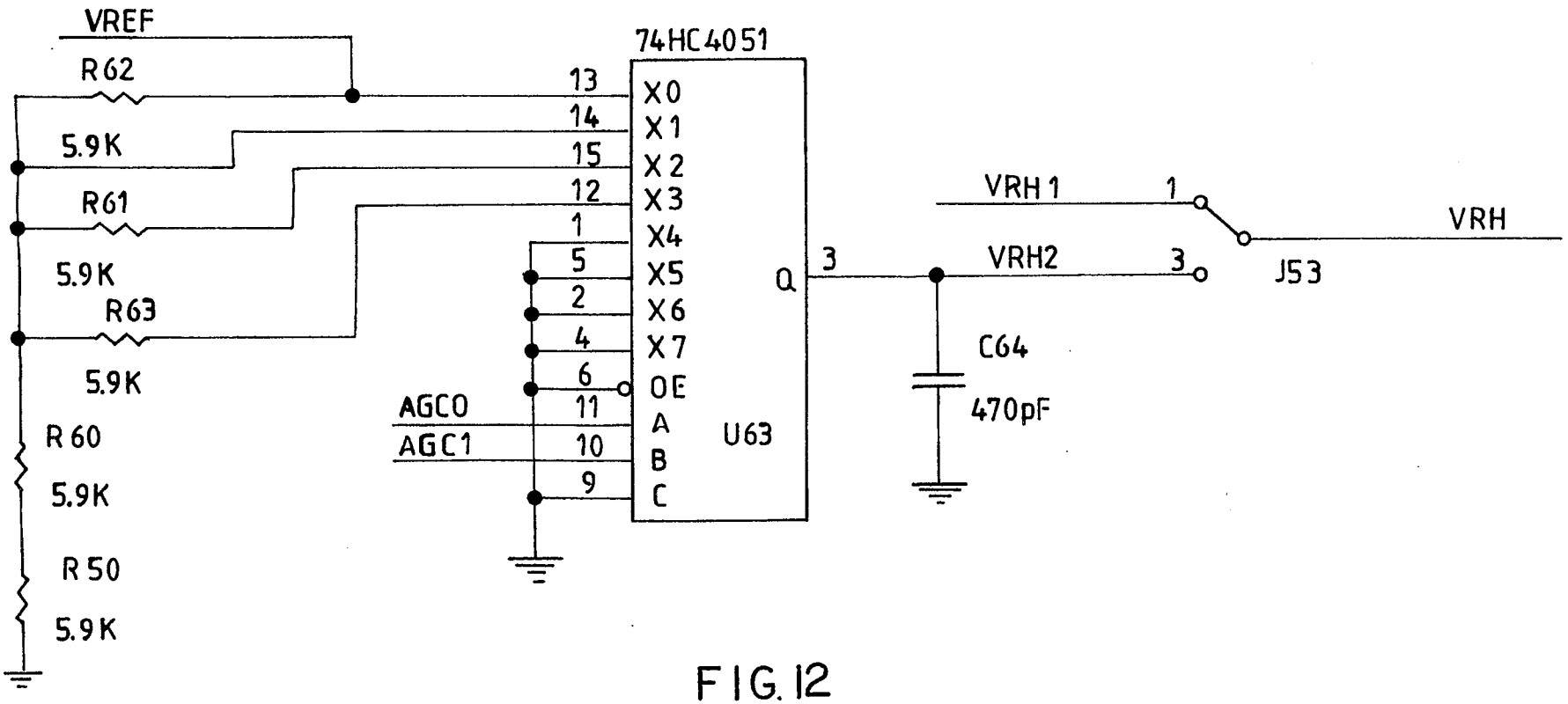
FIG. 12 is an electrical schematic illustration of an AGC circuit employed in the subsystem of FIG. 8.
Figure 13A:
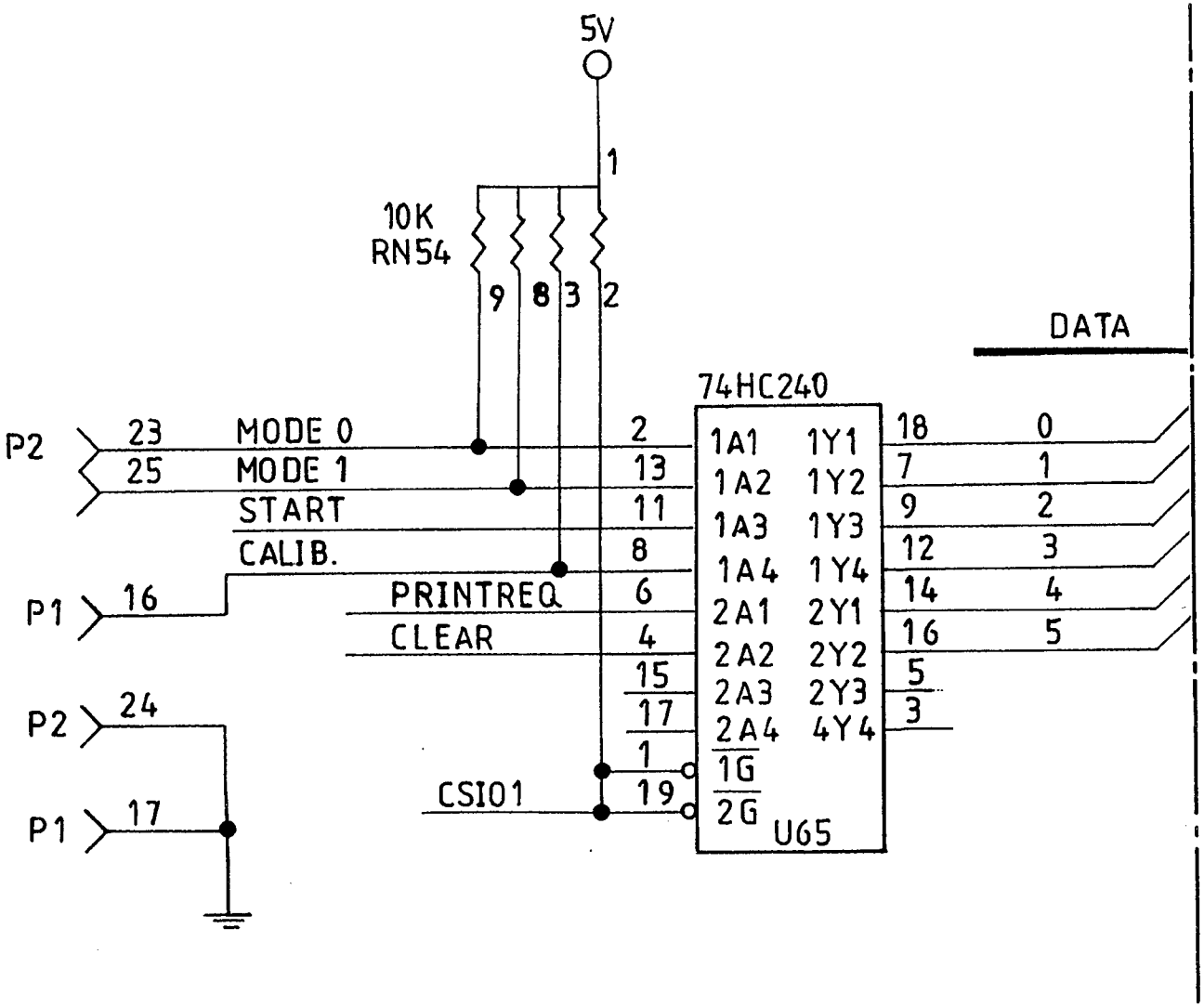
FIGS. 13A, 13B, 13C and 13D constitute an electrical schematic illustration of a CPU interface and operator control circuitry employed in the subsystem of FIG. 8.
Figures 13B, 13C:
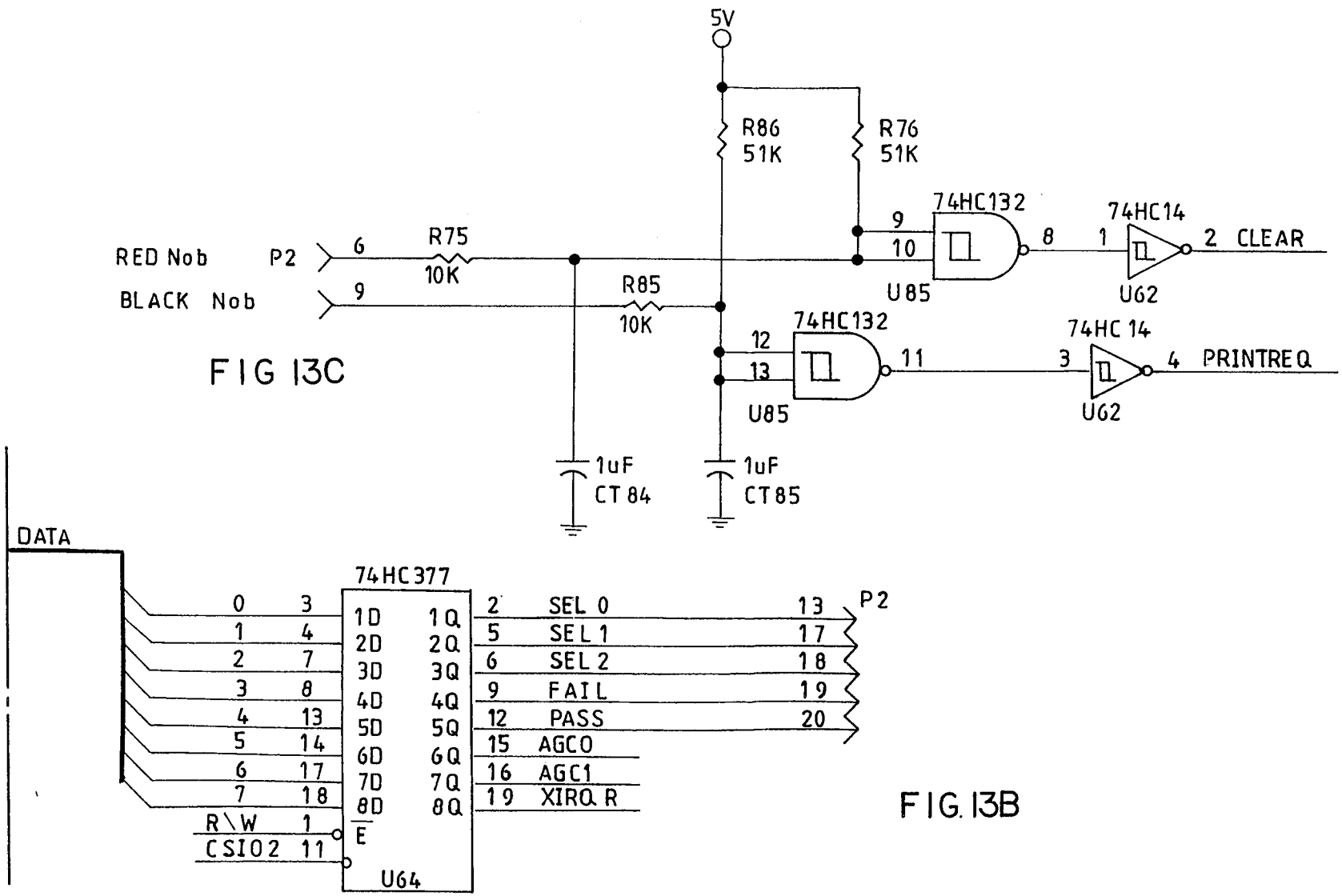
Figure 13D:
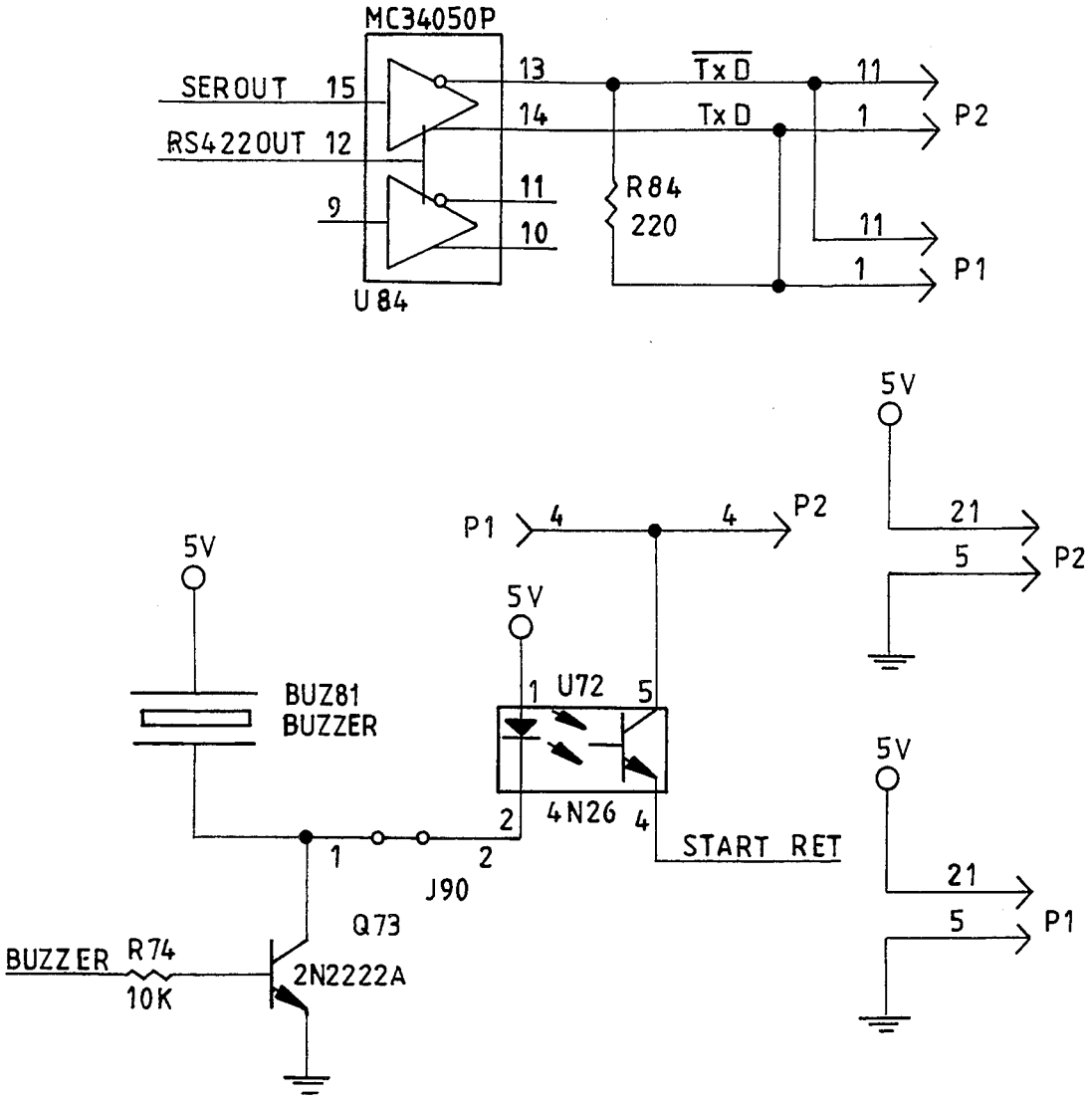

An automatic gain control circuit 92 is associated with the A/D converter 72 and is illustrated in electrical schematic form in FIG. 12. The multiplexer 76 is illustrated in electrical schematic form in FIG. 11, while the CPU 74 and its associated program memory 94 are illustrated in electrical schematic form in FIGS. 10A–10E. FIGS. 13A–13D constitute an electrical schematic diagram of CPU interface and operator control circuitry 96 associated with CPU 74.

Figure 14A:
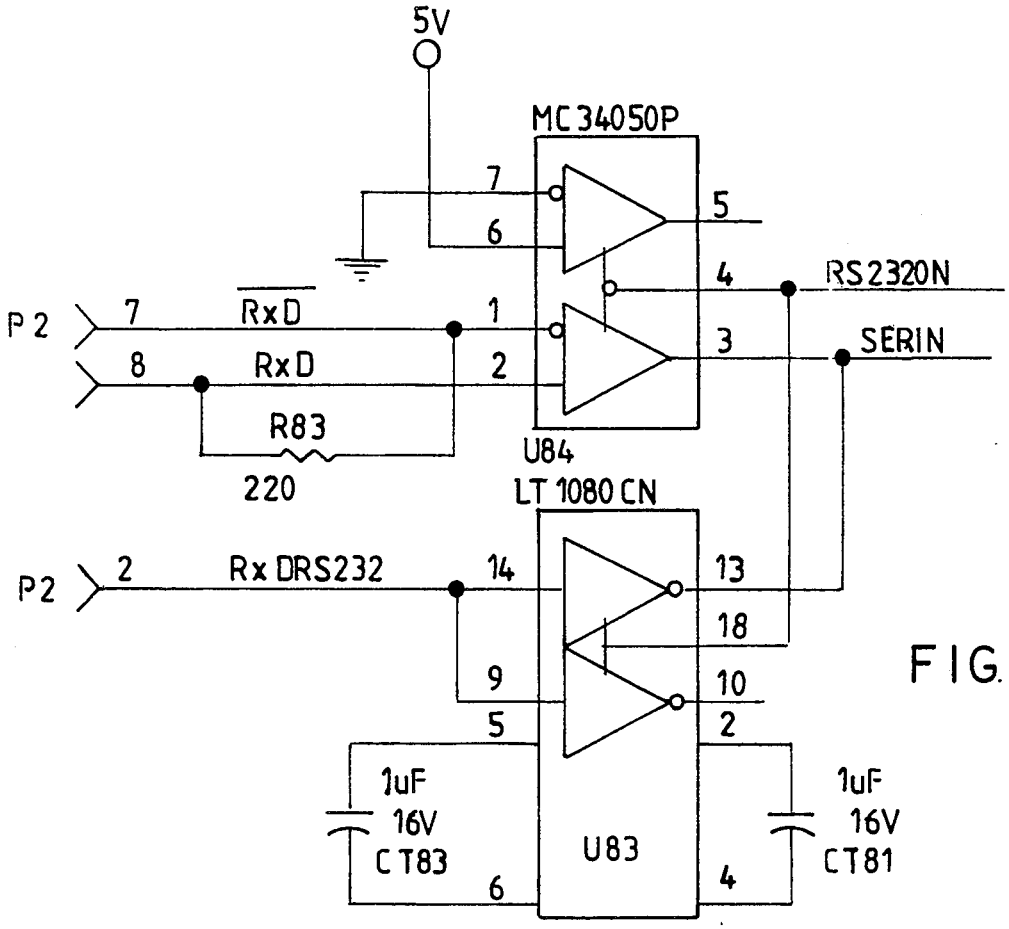
FIGS. 14A and 14B constitute an electrical schematic illustration of an RS 232/422 serial interface circuit employed in the subsystem of FIG. 8.
Figure 14B:
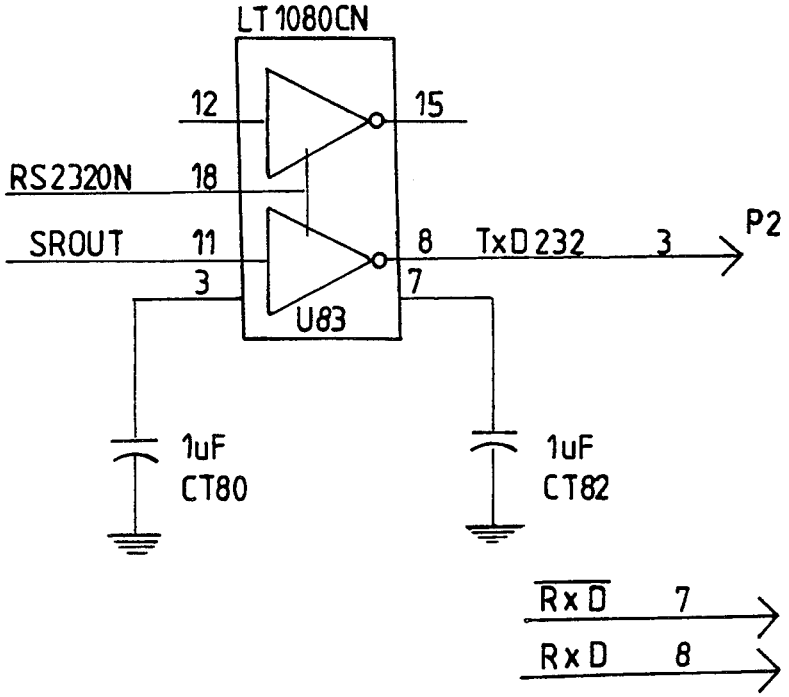

The CPU 74 outputs to output indication devices such as display 54 and printer 56 via an RS 232/422 interface 98, which is illustrated in the electrical schematic diagram of FIGS. 14A and 14B. A power supply 100, used to operate the subsystem of FIG. 8, is illustrated in FIGS. 17A–17D.

There is provided in Annex A, a computer listing of an operating program which is typically stored in program memory 94 and which enables CPU 74 to operate the subsystem of FIG. 8 to provide an output indication of the location of the impingement location 61 with respect to an appropriate target reference defined by or with respect to detectors 60.

It is appreciated that the dual mode designator of the present invention may advantageously be used with the target practice system of FIG. 4, but that any other suitable laser beam firing device may alternatively be employed.

It will be appreciated by persons skilled in the art that the invention is not limited by what has been particularly shown and described hereinabove. Rather the scope of the present invention is defined only by the claims which follow:

We claim:

1. Dual mode apparatus for assisting in the aiming of a firearm comprising:

laser designating means boresighted with the barrel of the firearm;

means for actuating the laser designating means in a first mode of operation for target designation to illuminate a target while permitting normal operation of the firearm to shoot projectiles and including an operator control switch whose actuation produces a laser output of the laser designating means; and means for actuating the laser designating means in a second mode of operation for target practice to illuminate a target with a laser beam emission in response to actuation of the trigger of the firearm and incorporating a firing sensor whose output produces a laser beam simulated firing.

2. A target practice system comprising:

laser designating means boresighted with the barrel of the firearm;

means for actuating the laser designating means to illuminate a target with laser light at an impingement location in response to actuation of the trigger of the firearm;

target means defining a target reference and including sensor means for sensing the spatial relationship between the impingement location and the target reference, said target means including:

a laser light diffuser which produces scattering of incoming laser light in a known geometrical distribution; and a plurality of detectors for sampling said distribution and thus providing an output indication of the position of said impingement location relative to said target reference; and means for providing a hard copy output indication of the spatial relationship between the impingement location and the target reference.

3. A system according to claim 2 and wherein said laser designating means includes dual mode laser designating means and also includes:

means for actuating the laser designating means in an actual firing mode of operation for illuminating a target while permitting normal operation of the firearm to shoot projectiles.

4. A target practice system comprising:

laser designating means boresighted with the barrel of the firearm;

means for actuating the laser designating means in a first mode of operation for target designation to illuminate a target while permitting normal operation of the firearm to shoot projectiles and including operator control switch whose actuation produces a laser output of the laser designating means;

means for actuating the laser designating means in a second mode of operation for target practice to illuminate a target with a laser beam emission in response to actuation of the trigger of the firearm and incorporation a firing sensor whose output produces a laser beam simulated firing; and target means defining a target reference and including sensor means for sensing the spatial relationship between the impingement location and the target reference, said target means including:

a laser light diffuser which produces scattering of incoming laser light in a known geometrical distribution; and a plurality of detectors for sampling said distribution and thus providing an output indication of the position of said impingement location relative to said target reference; and means for providing a hard copy output indication of the spatial relationship between the impingement location and the target reference.

5. A target practice system comprising:

laser designating means boresighted with the barrel of the firearm;

means for actuating the laser designating means to illuminate an impingement location on a target with laser light in response to actuation of the trigger of the firearm; and target means defining a target reference and including sensor means for sensing the spatial relationship between the impingement location and the target reference, the target means comprising a laser light diffuser for scattering received laser light and said sensor means being operative for sensing the spatial distribution of the scattered received laser light.

6. A target practice system according to claim 4 and also comprising means for providing a hard copy output of the spatial relationship between the impingement location and the target reference.

7. A target practice system according to claim 5 and also comprising means for providing a hard copy output of the spatial relationship between the impingement location and the target reference.

* * * * *